US011279444B2

(12) United States Patent
Bourret et al.

(10) Patent No.: US 11,279,444 B2
(45) Date of Patent: Mar. 22, 2022

(54) ENGINE ASSEMBLY FOR A WATERCRAFT

(71) Applicant: BRP US INC., Sturtevant, WI (US)

(72) Inventors: Robert Bourret, Palm Bay, FL (US); Patrice Dusablon, Cocoa Beach, FL (US); Geno Mangubat, Indialantic, FL (US); Michael Rodgers, Merritt Island, FL (US)

(73) Assignee: BRP US INC.

( * ) Notice: Subject to any disclaimer, the term of this patent is extended or adjusted under 35 U.S.C. 154(b) by 355 days.

(21) Appl. No.: 16/549,322

(22) Filed: Aug. 23, 2019

(65) Prior Publication Data

US 2020/0198732 A1 Jun. 25, 2020

Related U.S. Application Data

(60) Provisional application No. 62/782,832, filed on Dec. 20, 2018.

(51) Int. Cl.

| | |
|---|---|
| ***B63B 3/14*** | (2006.01) |
| ***F02M 35/14*** | (2006.01) |
| ***B63H 21/30*** | (2006.01) |
| ***F02B 61/04*** | (2006.01) |
| ***B63B 34/10*** | (2020.01) |

(52) U.S. Cl.

CPC ..... *B63B 3/14* (2013.01); *B63B 34/10* (2020.02); *B63H 21/30* (2013.01); *F02B 61/045* (2013.01); *F02M 35/14* (2013.01)

(58) Field of Classification Search

CPC ..... B63B 3/14; B63B 34/10; B63H 21/30; F02M 35/14

See application file for complete search history.

(56) References Cited

U.S. PATENT DOCUMENTS

2002/0073971 A1* 6/2002 Katayama ..... F02B 61/045 123/478
2002/0155766 A1* 10/2002 Hattori ..... B63H 21/213 440/88 A
2002/0160672 A1* 10/2002 Hattori ..... F02M 35/112 440/88 A
2003/0024491 A1* 2/2003 Kinomoto ..... B63B 34/10 123/41.14
2011/0100315 A1* 5/2011 Vichinsky ..... F02M 35/112 123/184.53
2015/0090523 A1* 4/2015 Kinpara ..... F02M 35/1272 181/229

(Continued)

*Primary Examiner* — S. Joseph Morano
*Assistant Examiner* — Jovon E Hayes
(74) *Attorney, Agent, or Firm* — BCF LLP

(57) ABSTRACT

A watercraft includes a hull, an engine compartment defined at least in part by the hull, an engine disposed in the engine compartment, an air intake conduit fluidly connected to the engine, an air filter fluidly connected to the air intake conduit, and a shroud connected to an inlet end of the air intake conduit located in the engine compartment. The shroud has an open end and a closed end. The open end is open to flow of air therethrough and the closed end is closed to flow of air therethrough. The shroud has a sidewall extending between the closed and open ends. The shroud is oriented such that the open end is disposed rearward of the closed end. Noise exiting the inlet end of the air intake conduit and the air filter is reflected generally rearward by the shroud. An engine assembly for a watercraft is also disclosed.

37 Claims, 20 Drawing Sheets

(56) References Cited

U.S. PATENT DOCUMENTS

| | | | | |
|---|---|---|---|---|
| 2016/0031538 | A1* | 2/2016 | Harada | B63B 34/10<br>440/38 |
| 2016/0031539 | A1* | 2/2016 | Terada | B63H 11/04<br>440/38 |
| 2017/0361910 | A1* | 12/2017 | Morota | B63H 11/02 |
| 2017/0361913 | A1* | 12/2017 | Morota | F01N 13/12 |
| 2020/0198732 | A1* | 6/2020 | Bourret | F02M 35/14 |

* cited by examiner

ENGINE ASSEMBLY FOR A WATERCRAFT

CROSS-REFERENCE

The present application claims priority to U.S. Provisional Patent Application No. 62/782,832 filed on Dec. 20, 2018, the entirety of which is incorporated herein by reference.

FIELD

The present technology relates to engine assembly for a watercraft and a watercraft using same.

BACKGROUND

Some watercraft, such as jet boats which incorporate one or more jet propulsion systems, produce noise and vibrations which can be undesirable for the driver and/or passenger(s) of the watercraft. Notably, the engine of a watercraft emits noise and vibrations which travel through an air intake system feeding the engine. Often, the inlet of the air intake system is positioned at the front of the watercraft's engine compartment, where the air therein is typically cooler and dryer. However, the front of the engine compartment is usually near the driver and/or passenger seats of the watercraft, which increases the impact that noise and vibrations emitted through the air intake system can have on the driver and/or passengers. The problem can be further exacerbated when the engine is supercharged as higher frequency sounds and vibrations are produced thereby than in a normally aspirated engine.

Therefore, there is a need for a watercraft that at least partially addresses these drawbacks.

SUMMARY

It is an object of the present technology to ameliorate at least some of the inconveniences present in the prior art.

According to one aspect of the present technology, a watercraft is provided. The watercraft includes: a hull having a bow and a stern opposite the bow; an engine compartment defined at least in part by the hull; an internal combustion engine disposed in the engine compartment; an air intake conduit fluidly connected to the engine, the air intake conduit having an inlet end and an outlet end, the inlet end being located in the engine compartment; an air filter fluidly connected to the air intake conduit for filtering air flowing into the air intake conduit; and a shroud connected to the inlet end of the air intake conduit. The shroud has an open end and a closed end. The open end is open to flow of air therethrough. The closed end is closed to flow of air therethrough. The shroud has a sidewall extending between the closed and open ends. The shroud is oriented such that the open end is disposed rearward of the closed end. Noise exiting the inlet end of the air intake conduit and the air filter is reflected generally rearward by the shroud.

In some embodiments, the open end has a rear peripheral edge, the closed end has a front peripheral edge, and a perimeter of the rear peripheral edge is greater than a perimeter of the front peripheral edge.

In some embodiments, the rear and front peripheral edges are circular, and a diameter of the rear peripheral edge is greater than a diameter of the front peripheral edge.

In some embodiments, the shroud is generally frustoconical and the open end has a diameter that is greater than a diameter of the closed end.

In some embodiments, the inlet end of the air intake conduit is located in a front portion of the engine compartment.

In some embodiments, the engine includes: a crankcase; a crankshaft disposed at least in part in the crankcase; a cylinder block connected to the crankcase; at least one cylinder defined in the cylinder block; and at least one piston movably disposed within a corresponding one of the at least one cylinder. Each of the at least one piston is operatively connected to the crankshaft. The shroud is disposed forward of each of the at least one cylinder.

In some embodiments, the engine includes: a crankcase; a crankshaft disposed at least in part in the crankcase, the crankshaft extending longitudinally; a cylinder block connected to the crankcase; at least one cylinder defined in the cylinder block; and at least one piston movably disposed within a corresponding one of the at least one cylinder. Each of the at least one piston is operatively connected to the crankshaft. The air intake conduit extends parallel to the crankshaft.

In some embodiments, the watercraft also includes a supercharger fluidly connected between the outlet end of the air intake conduit and the engine to compress and feed air to the engine.

In some embodiments, the supercharger is disposed rearward of the engine.

In some embodiments, the air filter covers the inlet end of the air intake conduit.

In some embodiments, the shroud is connected to the air filter.

In some embodiments, the inlet end of the air intake conduit faces forwardly.

In some embodiments, the air intake conduit extends longitudinally.

In some embodiments, the inlet end and the outlet end of the air intake conduit are disposed on opposite longitudinal sides of the engine.

In some embodiments, the inlet end faces rearward.

In some embodiments, the air filter is generally tubular.

In some embodiments, the engine compartment is located at a rear portion of the watercraft.

In some embodiments, the watercraft also includes a driver seat and at least one passenger seat disposed behind the driver seat. The at least one passenger seat is proximate a front portion of the engine compartment.

In some embodiments, the watercraft also includes a jet propulsion system driven by the engine.

In some embodiments, the air filter is disposed inside the shroud.

In some embodiments, the air filter includes a pleated paper filtering member.

In some embodiments, the air intake conduit has a secondary inlet near the outlet end for ingress of blow-by gas into the air intake conduit.

In some embodiments, the watercraft also includes an air intake manifold. The air intake manifold and the air intake conduit are disposed on opposite lateral sides of the engine.

In some embodiments, the watercraft also includes a supercharger fluidly connected between the outlet end of the air intake conduit and the engine to compress and feed air to the engine. The supercharger is disposed laterally between the air intake manifold and the air intake conduit.

In some embodiments, the air intake conduit, the air filter and the shroud define in part an air intake system of the watercraft. The shroud is a front-most element of the air intake system.

In some embodiments, the watercraft also includes a deck disposed on top of and connected to the hull. The deck also defines the engine compartment.

In some embodiments, the air intake conduit is a straight pipe.

In some embodiments, the watercraft also includes a supercharger fluidly connected between the outlet end of the air intake conduit and the engine to compress and feed air to the engine. The air intake conduit is vertically higher than the supercharger.

In some embodiments, the air intake conduit, the shroud, and the air filter are coaxial with one another.

In some embodiments, the sidewall of the shroud extends at an angle between 5° and 15° relative to a longitudinal axis of the shroud.

According to another aspect of the present technology, there is provided an engine assembly for a watercraft. The engine assembly includes an internal combustion engine including: a crankcase; a crankshaft disposed at least in part in the crankcase; a cylinder block connected to the crankcase; at least one cylinder defined in the cylinder block; and at least one piston movably disposed within a corresponding one of the at least one cylinder. Each of the at least one piston being operatively connected to the crankshaft. The engine assembly also includes: an air intake conduit fluidly connected to the engine, the air intake conduit having an inlet end and an outlet end, the inlet end being disposed on a first side of the engine, the outlet end of the air intake conduit being disposed on a second side of the engine, the first side being opposite the second side; an air filter fluidly connected to the air intake conduit for filtering air flowing into the air intake conduit; and a shroud connected to the inlet end of the air intake conduit. The shroud has an open end and a closed end. The open end is open to flow of air therethrough. The closed end is closed to flow of air therethrough. The shroud has a sidewall extending between the closed and open ends. The shroud is oriented such that a distance between the open end and the second side of the engine is less than a distance between the closed end and the second side of the engine.

In some embodiments, the air intake conduit extends parallel to the crankshaft.

In some embodiments, each of the at least one cylinder of the engine is disposed between the shroud and the second side of the engine.

In some embodiments, the engine assembly also includes a supercharger fluidly connected between the outlet end of the air intake conduit and the engine to compress and feed air to the engine.

In some embodiments, the supercharger is disposed on the second side of the engine.

In some embodiments, the watercraft also includes an air intake manifold. The air intake manifold and the air intake conduit are disposed on opposite lateral sides of the engine.

In some embodiments, the supercharger is disposed laterally between the air intake manifold and the air intake conduit.

For purposes of this application, the terms related to spatial orientation such as forwardly, rearward, left and right, are as they would normally be understood by a driver of a vehicle sitting thereon in a normal driving position.

Embodiments of the present technology each have at least one of the above-mentioned objects and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of embodiments of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

The present technology will be described with respect to a jet boat having a jet propulsion system. However, it is contemplated that aspects of the present technology could be applied to other types of watercraft, such as a personal watercraft.

Figure 1:
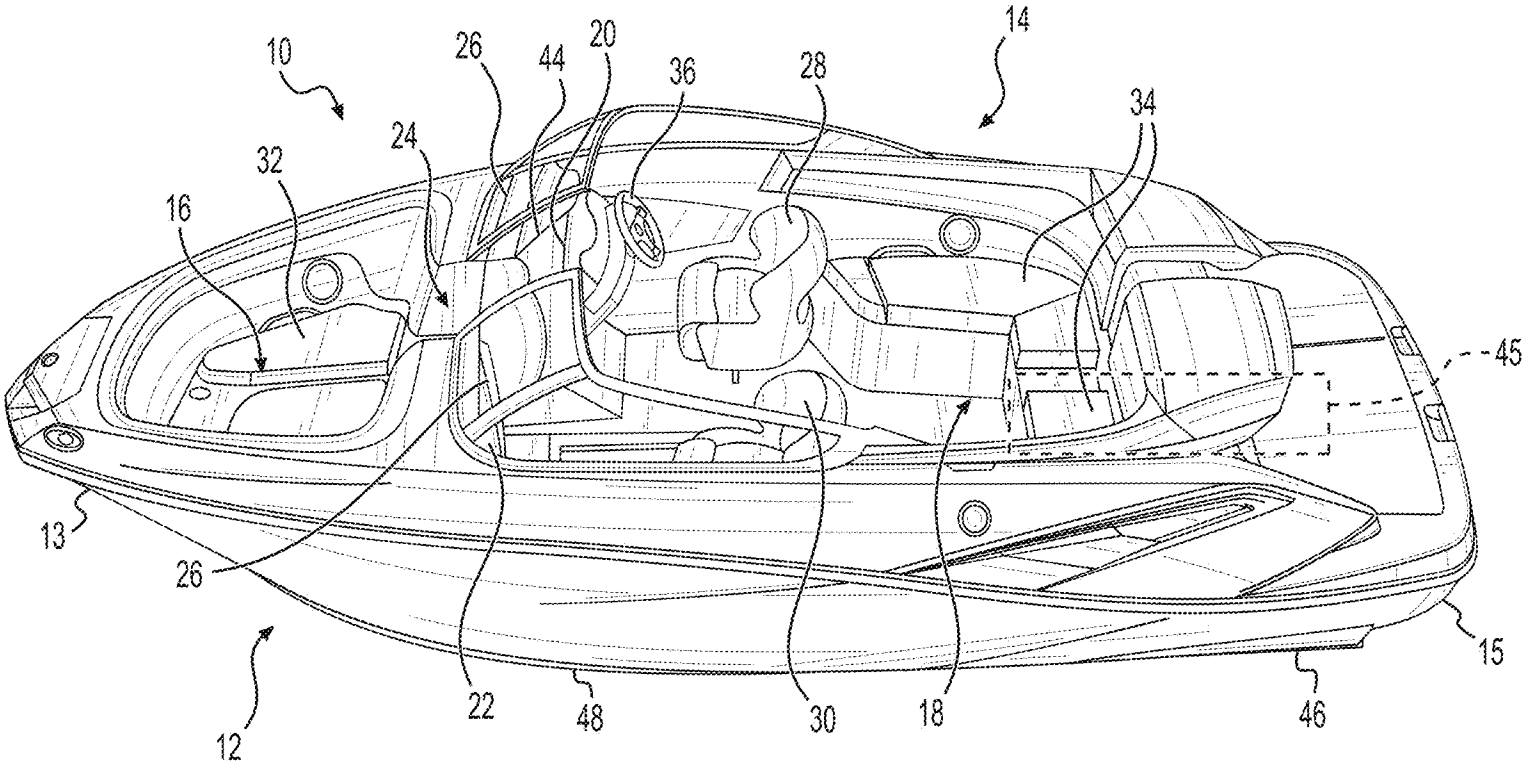
FIG. 1 is a perspective view taken from a left side of a jet boat.

The general construction of a jet boat 10 will be described with respect to FIG. 1. It should be understood that the jet boat 10 could have a construction other than the one described.

The jet boat 10 has a hull 12 and a deck 14 connected to and supported by the hull 12. The hull 12 buoyantly supports the jet boat 10 in the water and has a bow 13 and a stern 15 opposite the bow 13. The deck 14 has a forward passenger area 16 and a rearward passenger area 18. A right console 20 and a left console 22 are disposed on either side of the deck 14 between the two passenger areas 16, 18. A passageway 24 disposed between the two consoles 20, 22 allows for communication between the two passenger areas 16, 18. Windshields 26 are provided over the consoles 20, 22.

A driver seat 28 and a passenger seat 30 are disposed behind the consoles 20 and 22 respectively. Passenger seats 32 and 34 are also provided in the forward and rearward passenger areas 16 and 18 respectively. As can be seen, the passenger seats 32 are disposed in front of the driver seat 28 while the passenger seats 34 are disposed behind the driver seat 28.

The right console 20 is provided with a steering wheel 36, a shift input device in the form of a reverse gate lever (not shown), a throttle lever (not shown), and a joystick (not shown) used by the driver of the jet boat 10 to control the movement of the jet boat 10. It is contemplated that the transmission lever could be replaced by one or more switches or buttons. It is contemplated that the throttle lever could be replaced by a foot actuated pedal. A display area or cluster 44 is located forwardly of the steering wheel 36. The display cluster 44 can be of any conventional display type, including a liquid crystal display (LCD), dials or LED (light emitting diodes). The right console 20 has various buttons (not shown), which could alternatively be in the form of levers or switches, that allow the driver to modify the display data or mode (speed, engine rpm, time, etc.) on the display cluster 44. Additional buttons, switches and levers (not shown) are also provided to allow the driver to control other elements of the boat such as, for example, lights and bilge pumps.

The hull 12 is provided with a combination of strakes 46 and chines 48. A strake 46 is a protruding portion of the hull 12. A chine 48 is the vertex formed where two surfaces of the hull 12 meet. The combination of strakes 46 and chines 48 provide the jet boat 10 with its riding and handling characteristics.

Figure 2:
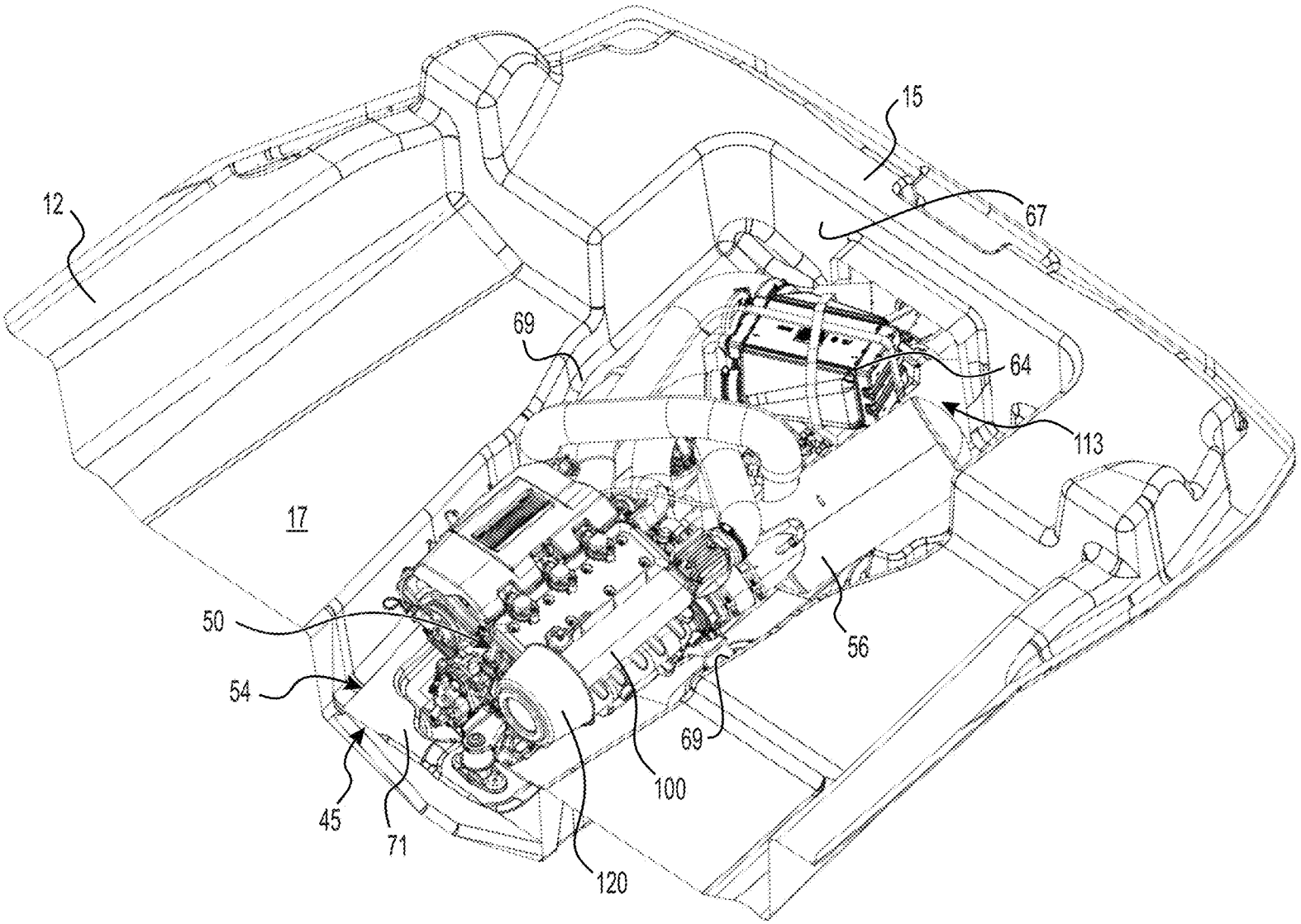
FIG. 2 is a perspective view taken from a front, left side of a rear part of a hull of the jet boat of FIG. 1 with an engine compartment shown therein, and with an engine assembly disposed in the engine compartment.
Figure 3:
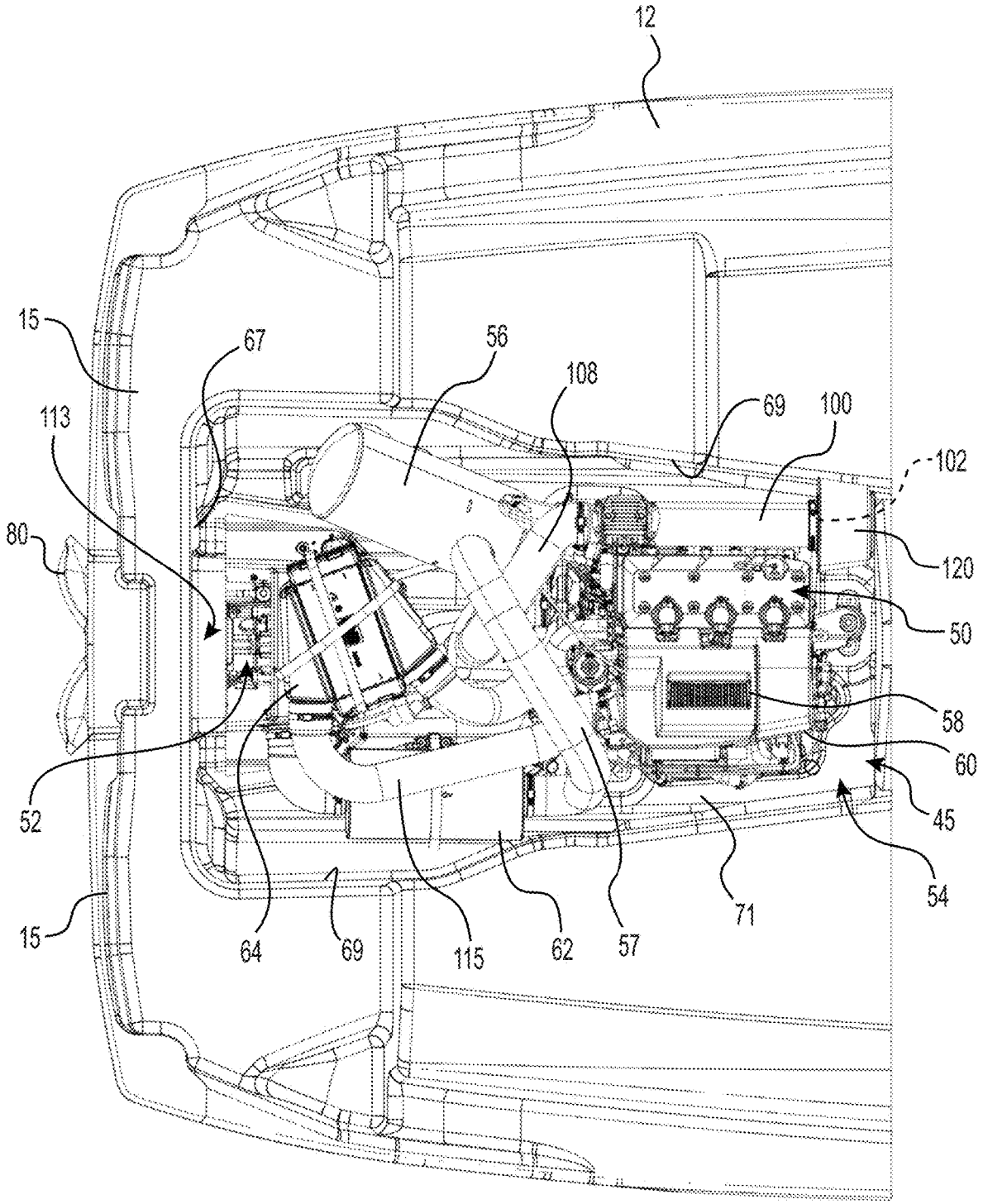
FIG. 3 is a top plan view of the part of the hull and engine assembly of FIG. 2.

As shown in FIGS. 2 and 3, an internal combustion engine 50 is disposed in an engine compartment 45 defined between the hull 12 and the deck 14 at the back of the jet boat 10. The engine compartment 45 is located at a rear portion 17 of the jet boat 10 that is forward of the stern 15. The engine compartment 45 has a rear wall 67, left and right side walls 69, and a bottom wall 71. Each of the rear wall 67, the side walls 69 and the bottom wall 71 is defined by the hull 12. The engine compartment 45 also has a top wall (not shown) defined by a floor of the deck 14. An access hatch (not shown) defined in the floor of the deck 14 provides access to the engine compartment 45. The engine compartment 45 also has front wall (not shown) extending between the hull 12 and the deck 14.

The engine 50 is a four-stroke engine and drives a jet propulsion system 52 (also commonly referred to as a "jet pump drive") which propels the jet boat 10. The engine compartment 45 accommodates the engine 50, as well as a muffler 56, electrical system (battery, electronic control unit (ECU) 58, etc.), intake manifold 60, resonator 62, intercooler 64, engine oil cooler 65 (FIG. 4) and other elements required or desirable in the jet boat 10. It is contemplated that, in some embodiments, the engine 50 could drive two or more jet propulsion systems. A majority of the jet propulsion system 52 is located in a recess formed at the back of the hull 12, and referred to as a tunnel. The jet propulsion system 52 will be described in greater detail below.

Figure 7:
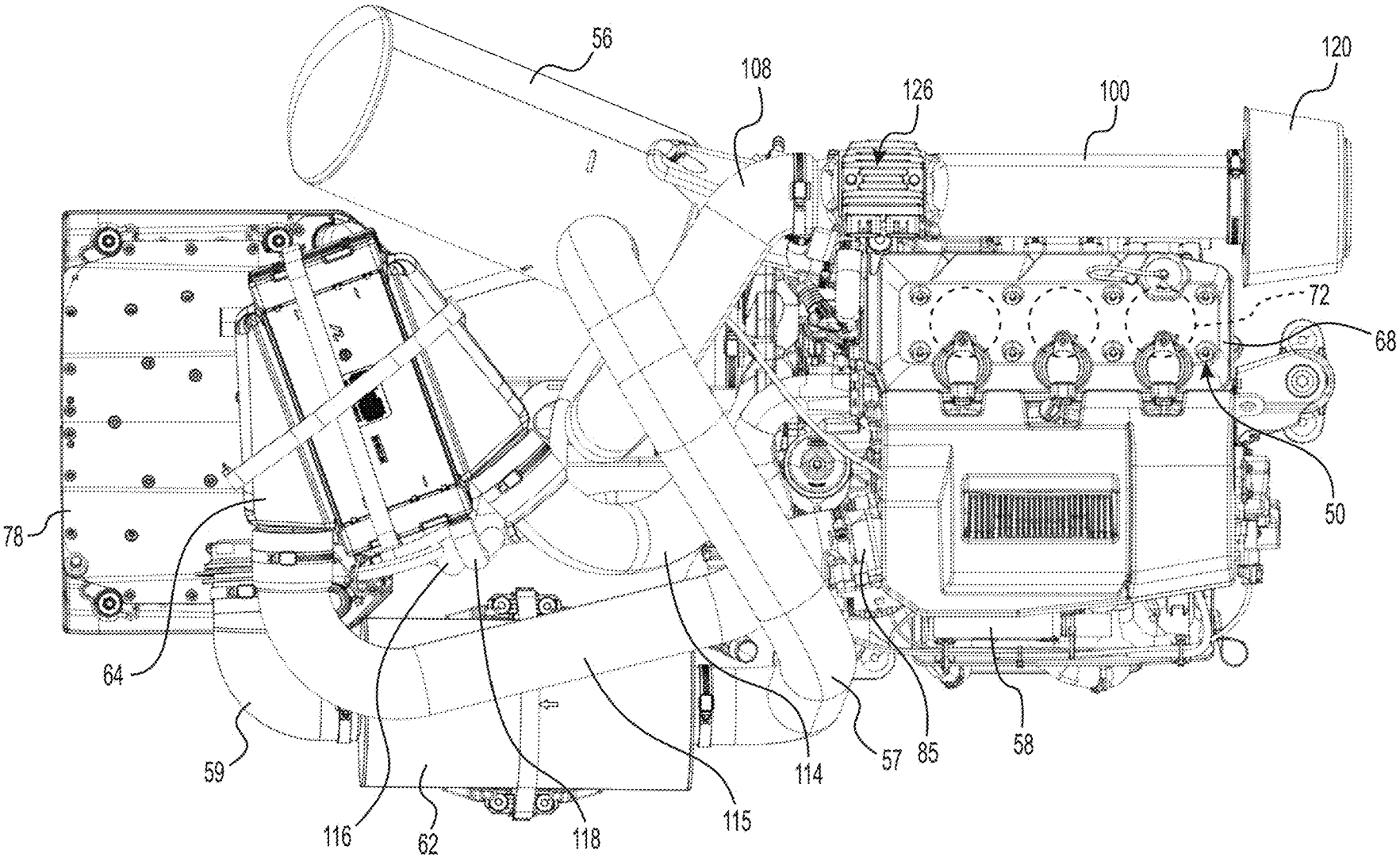
FIG. 7 is a top plan view of the engine assembly of FIG. 5.
Figure 8:
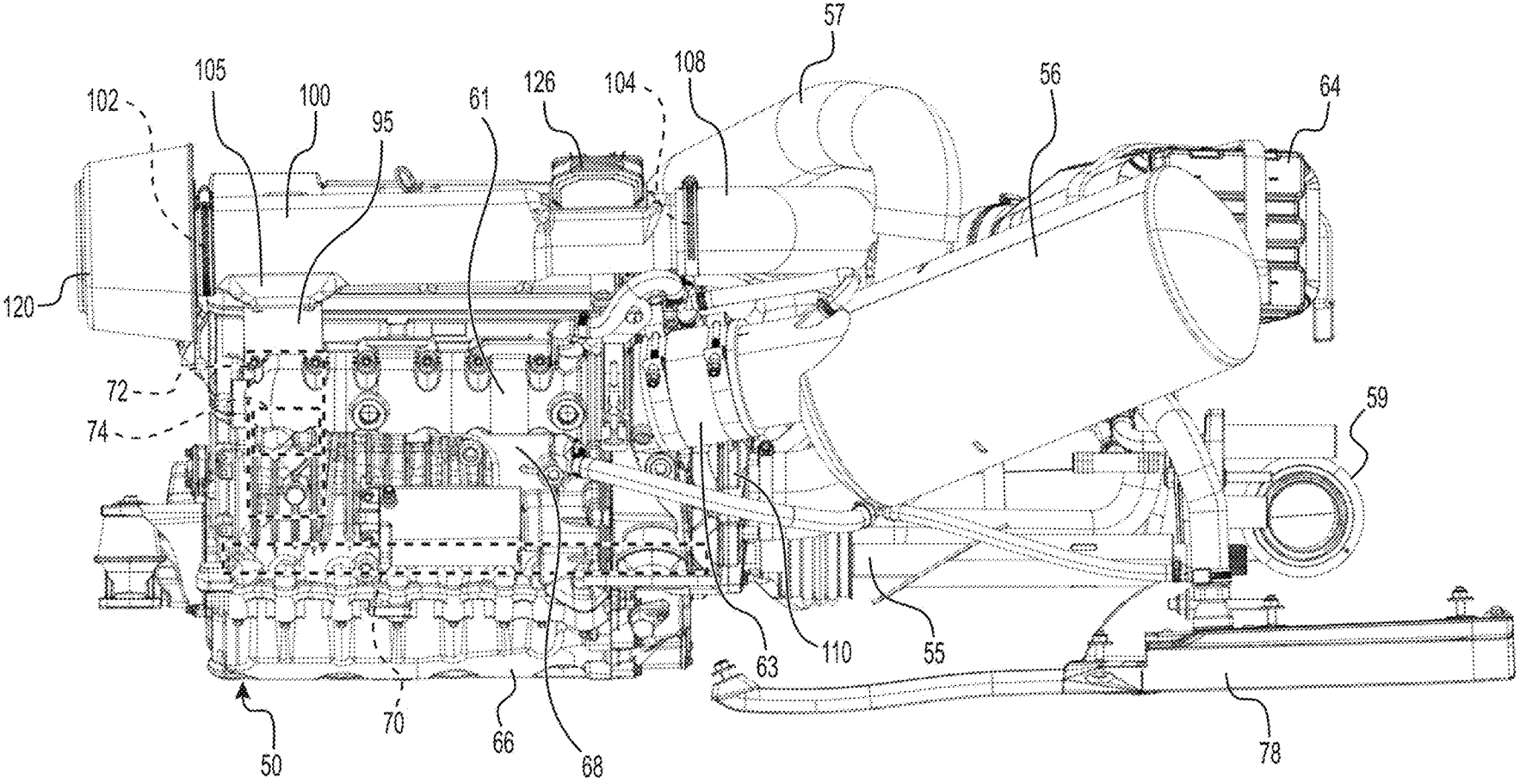
FIG. 8 is a left side elevation view of the engine assembly of FIG. 5.

Turning now to FIGS. 7 and 8, the engine 50 has a crankcase 66 and a cylinder block 68 connected to the crankcase 66. A crankshaft 70 (partially illustrated in dotted lines in FIG. 8) is disposed in the crankcase 66 and extends longitudinally (i.e., a crankshaft rotation axis thereof extends longitudinally). The cylinder block 68 defines three cylinders 72 (shown in dotted lines in FIG. 7). As such the engine 50 is referred to as a three-cylinder engine. It is contemplated that the engine 50 could have more or fewer cylinders in other embodiments. Each cylinder 72 has an associated piston 74 (one of which is shown in dotted lines in FIG. 8) movably disposed therein and operatively connected to the crankshaft 70 to drive the crankshaft 70. A driveshaft 55 is connected to the crankshaft 70 and is connected to the jet propulsion system 52 to drive the jet propulsion system 52.

As mentioned above, the jet boat 10 is propelled by the jet propulsion system 52 which pressurizes water to create thrust. To that end, the jet propulsion system 52 has a duct in which water is pressurized and which is defined by various components of the jet propulsion system 52. Notably, with reference to FIG. 4, the duct is defined in part by an intake ramp, an impeller housing 75, a venturi unit 76 and a steering nozzle 77 of the jet propulsion system 52. The impeller housing 75, the venturi unit 76 and the steering nozzle 77 are disposed in the tunnel 113 (FIGS. 2 and 3). The tunnel 113 is a cavity that is opened at the rear of the hull 12, is defined at the front, top and sides by the hull 12, and having a bottom that is closed by a ride plate 78. The ride plate 78 creates a surface on which the jet boat 10 rides or planes at high speeds.

Figure 4:
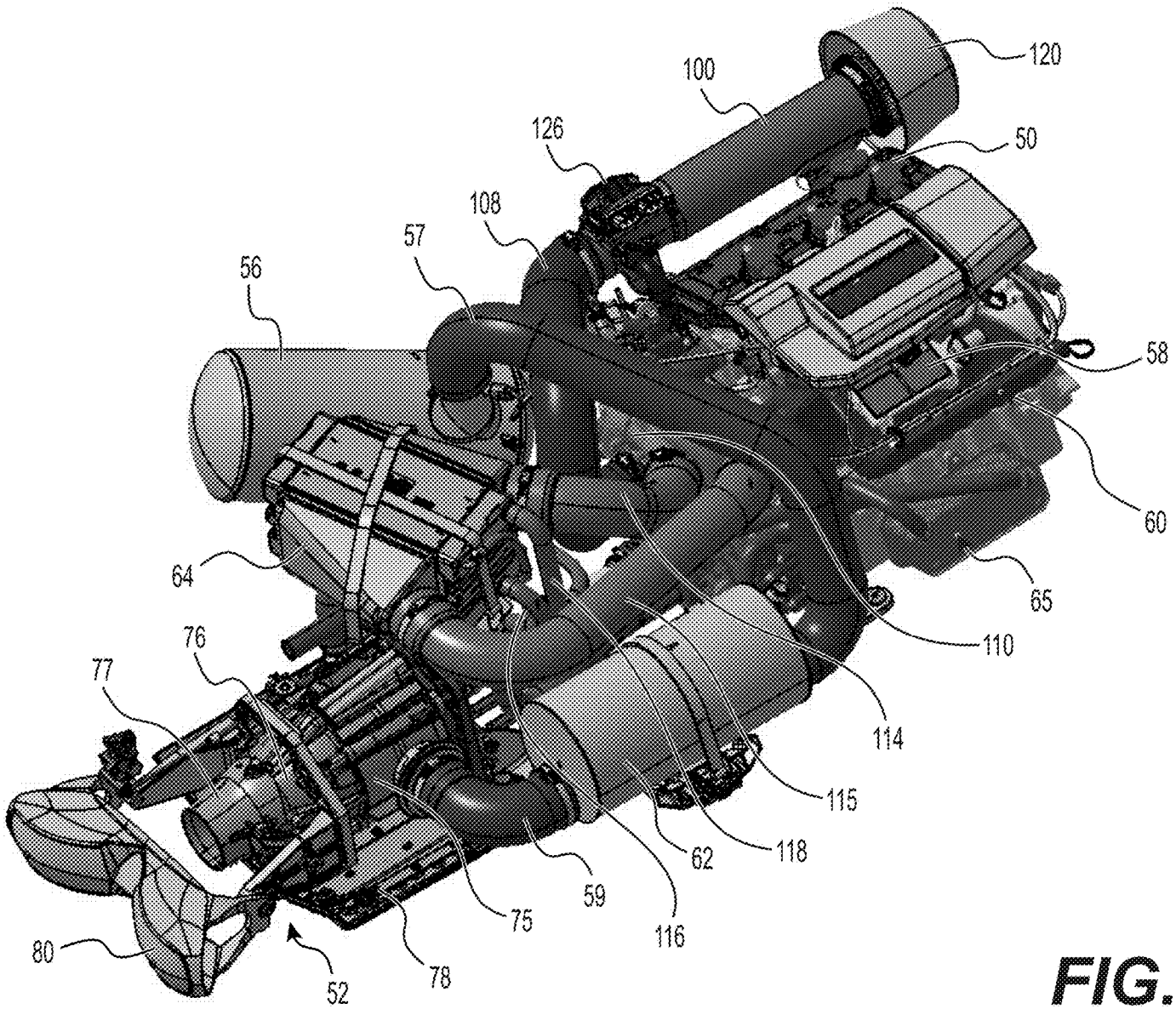
FIG. 4 is a perspective view taken from a rear, right side of the engine assembly and a jet propulsion system of the jet boat of FIG. 1.

As can be see in FIGS. 3 and 4, the jet boat 10 is also provided with a reverse gate 80 which is movable between a stowed position where it does not interfere with the jet of water being expelled rearward along the duct by the jet propulsion system 52 and a plurality of positions where it redirects the jet of water being expelled rearward along the duct by the jet propulsion system 52. Notably, the reverse gate 80 can be actuated into a neutral position in which the thrust generated by the jet propulsion system 52 does not have a horizontal component such that the jet boat 10 will not be accelerated or decelerated by the thrust. The reverse gate 80 can also be actuated into a reverse position as it redirects the jet of water towards the front of the jet boat 10, thus causing the jet boat 10 to move in a reverse direction.

The jet boat 10 includes other features, well known in the art, that will not be described herein, such as the electrical and fuel systems for example. It should be understood that such features are nonetheless present in the jet boat 10.

As will be described in detail below with reference to FIGS. 4 to 10, an engine assembly of the jet boat 10 includes an air intake system defined by various components for feeding air to the engine 50.

Notably, air flow into the air intake system begins at an air intake conduit 100 thereof. As will be described below, the air intake conduit 100 is in fluid communication with the engine 50 to provide air flow thereto. The air intake conduit 100 has an inlet end 102 and an outlet end 104 opposite the inlet end 102 (see FIGS. 3 and 17 for example). The air intake conduit 100, and its associated components such as a shroud 120 connected thereto, will be described in greater detail below.

The air intake system of the engine 50 also includes a supercharger 110 (FIGS. 4 and 10) which is fluidly connected between the outlet end 104 of the air intake conduit 100 and the engine 50. Notably, a conduit 108 fluidly connects the outlet end 104 of the air intake conduit 100 to the supercharger 110. The supercharger 110, which is driven by the engine 50, compresses air flowing thereto from the air intake conduit 100 to feed the compressed air to the engine 50. As can be seen in FIG. 4, the supercharger 110 is disposed on a rear side of the engine 50. The supercharger 110 has a conventional construction and therefore will not be further described herein.

As shown in FIGS. 4 and 7, the intercooler 64 is fluidly connected to an outlet of the supercharger 110 via a conduit 114 and thus receives compressed air therefrom. The intercooler 64 reduces the temperature of the air compressed by the supercharger 110 so as to increase power output of the engine 50. In this embodiment, the intercooler 64 is an air-to-liquid intercooler which uses water to cool the compressed air fed thereto by the supercharger 110. The intercooler 64 thus has a fluid inlet and a fluid outlet connected to respective conduits 116, 118 for circulating water through the intercooler 64. The conduit 116 fluidly connects the fluid inlet of the intercooler 64 to the jet propulsion system 52, which pumps water thereto. The conduit 118 fluidly connects the fluid outlet of the intercooler 64 to a port along the exterior of the hull 12 at the stern 15.

The air cooled by the intercooler 64 then flows to a throttle body 85 (FIGS. 7 and 9) via a conduit 115 which fluidly connects an air outlet of the intercooler 64 to an inlet of the throttle body 85. An opening of the throttle body 85 is regulated by a throttle valve (not shown) responsive to the input of the driver at the throttle lever of the watercraft 10.

Figure 6:
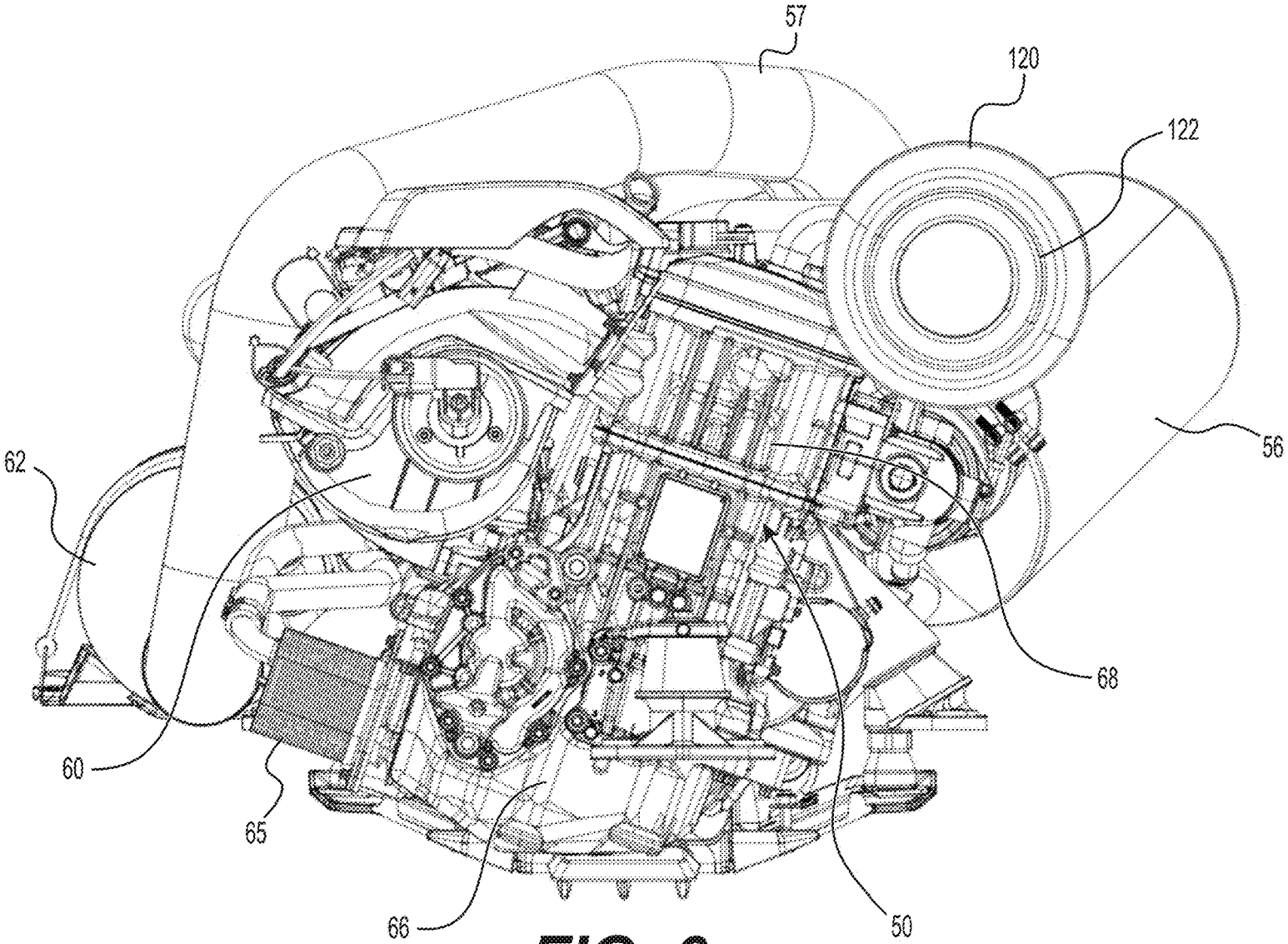
FIG. 6 is a front elevation view of the engine assembly of FIG. 5.
Figure 9:
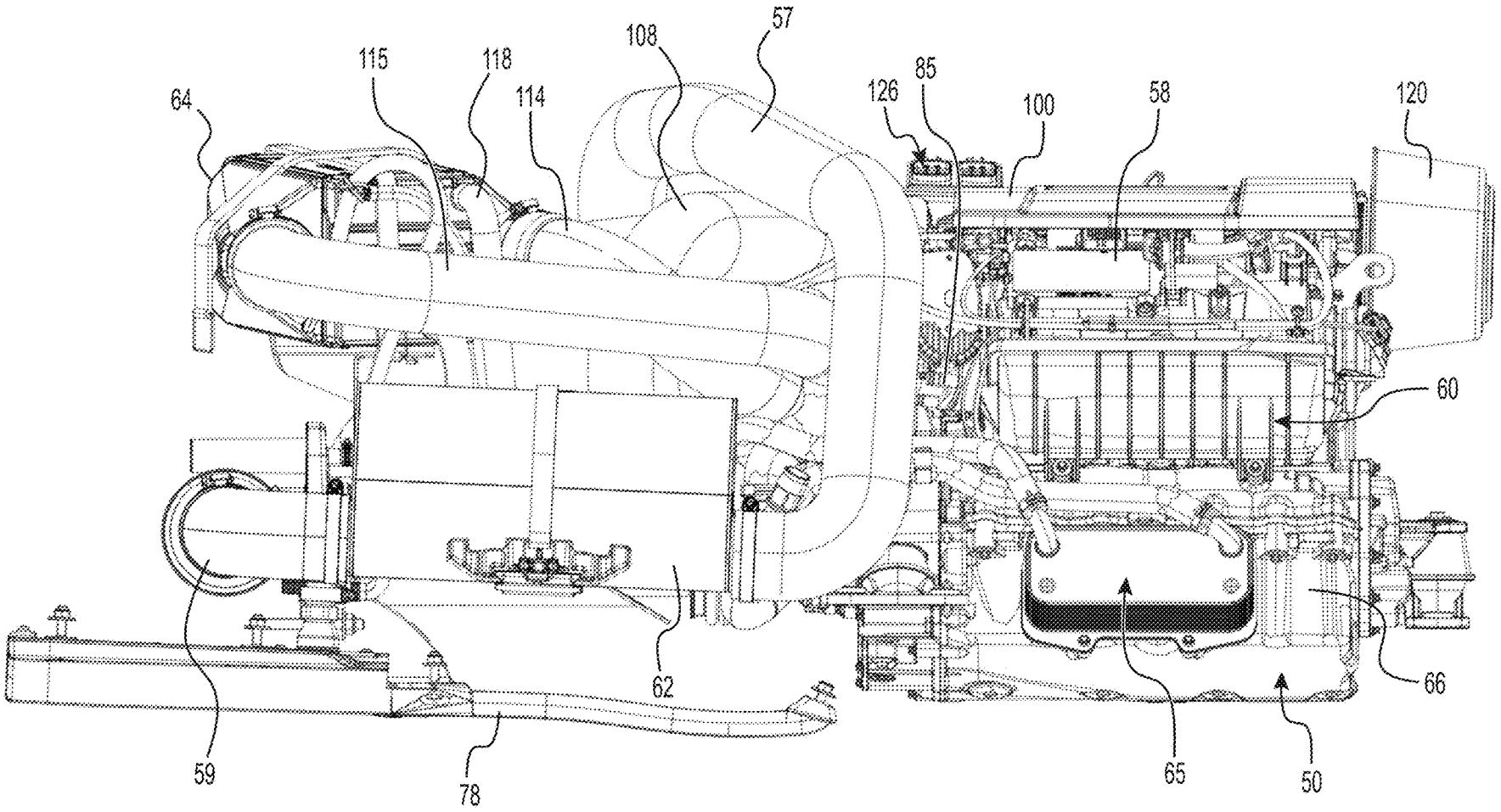
FIG. 9 is a right side elevation view of the engine assembly of FIG. 5.

As show in FIGS. 4, 6, 9, the air intake system also includes the intake manifold 60 that is fluidly connected to an outlet of the throttle body 85. The intake manifold 60 is disposed on a right side of the engine 50 (i.e., on an opposite lateral side of the engine 50 from the air intake conduit 100). As such, the supercharger 110 is disposed laterally between the intake manifold 60 and the air intake conduit 100. The intake manifold 60 is fluidly connected to each of the cylinders 72 of the engine 50 to feed air to the cylinders 72.

The engine assembly of the jet boat 10 has an exhaust system to evacuate exhaust gases from the engine 50. Notably, the exhaust system includes an exhaust manifold 61 (FIG. 5) disposed on the left side of the engine 50 and that is fluidly connected to exhaust ports (not shown) of the cylinders 72 of the engine 50. In turn, the exhaust manifold 61 is fluidly connected to the muffler 56, which is disposed on a same side of the crankshaft 70 as the exhaust manifold 61, via a conduit 63. The muffler 56 reduces the noise emitted by the engine 50 via the exhaust system.

The muffler 56 is fluidly connected by a conduit 57 to the resonator 62. The resonator 62 and the muffler 56 are disposed on opposite sides of the crankshaft 70. The resonator 62 cancels out a selected range of sound frequencies from the noise emitted by the engine 50. In turn, the resonator 62 is fluidly connected via a conduit 59 to the tunnel 113 inside which the exhaust gases are released.

Figure 5:
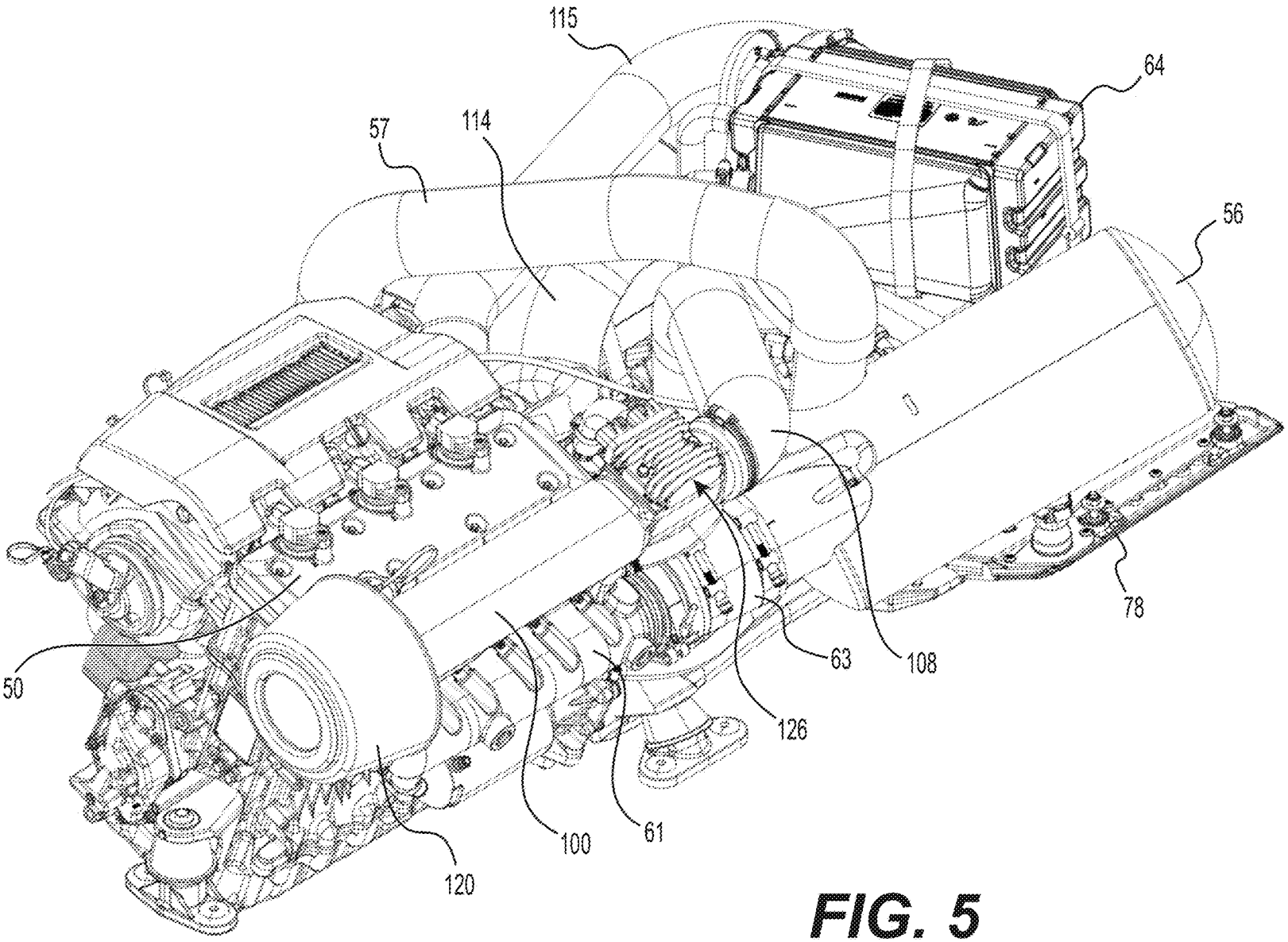
FIG. 5 is a perspective view taken from a front, left side of the engine assembly of FIG. 4.
Figure 10:
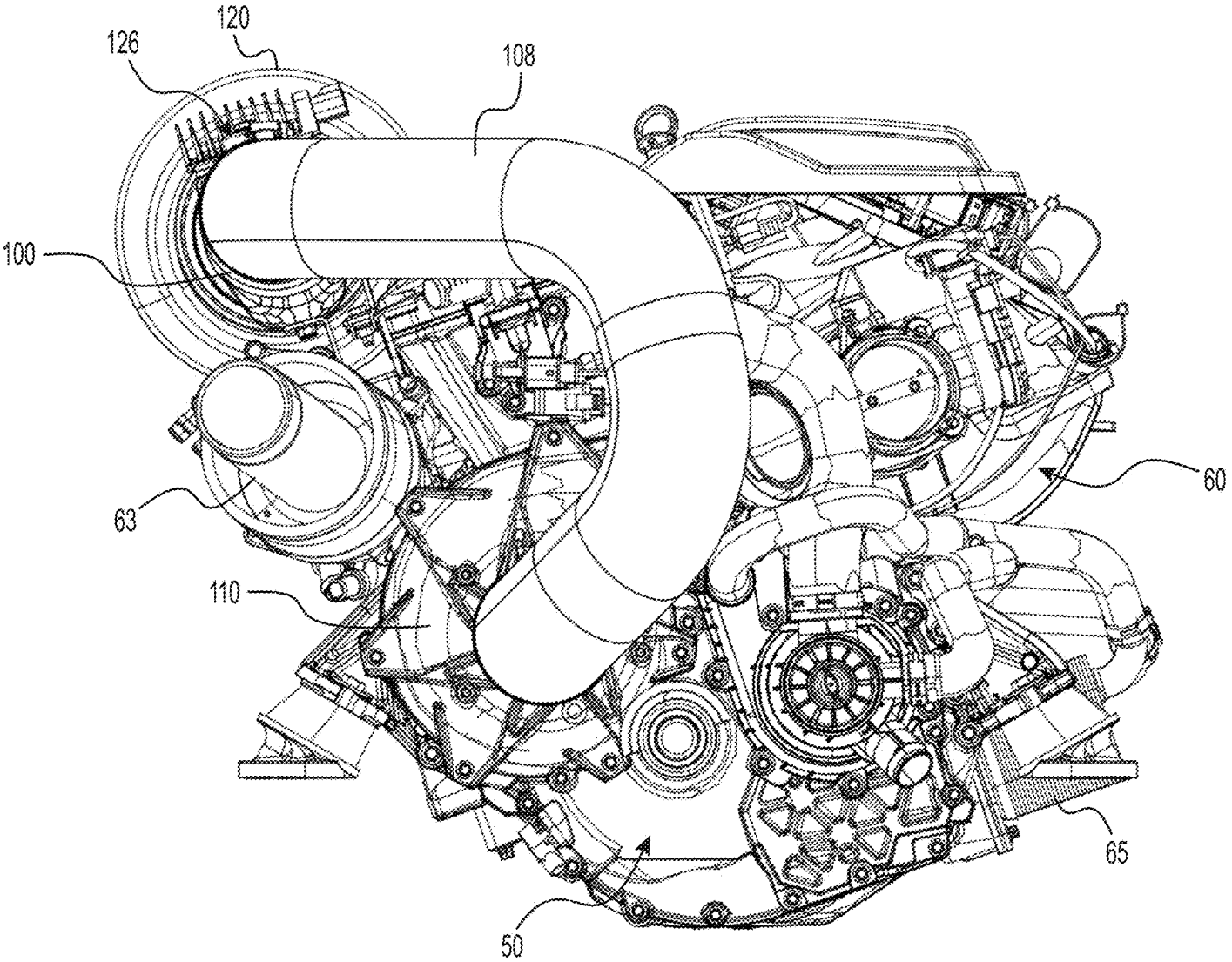
FIG. 10 is a rear elevation view of the engine assembly of FIG. 5, with components such as a muffler, a resonator, an intercooler and various conduits removed therefrom to more clearly show a supercharger of the engine assembly.
Figure 11:
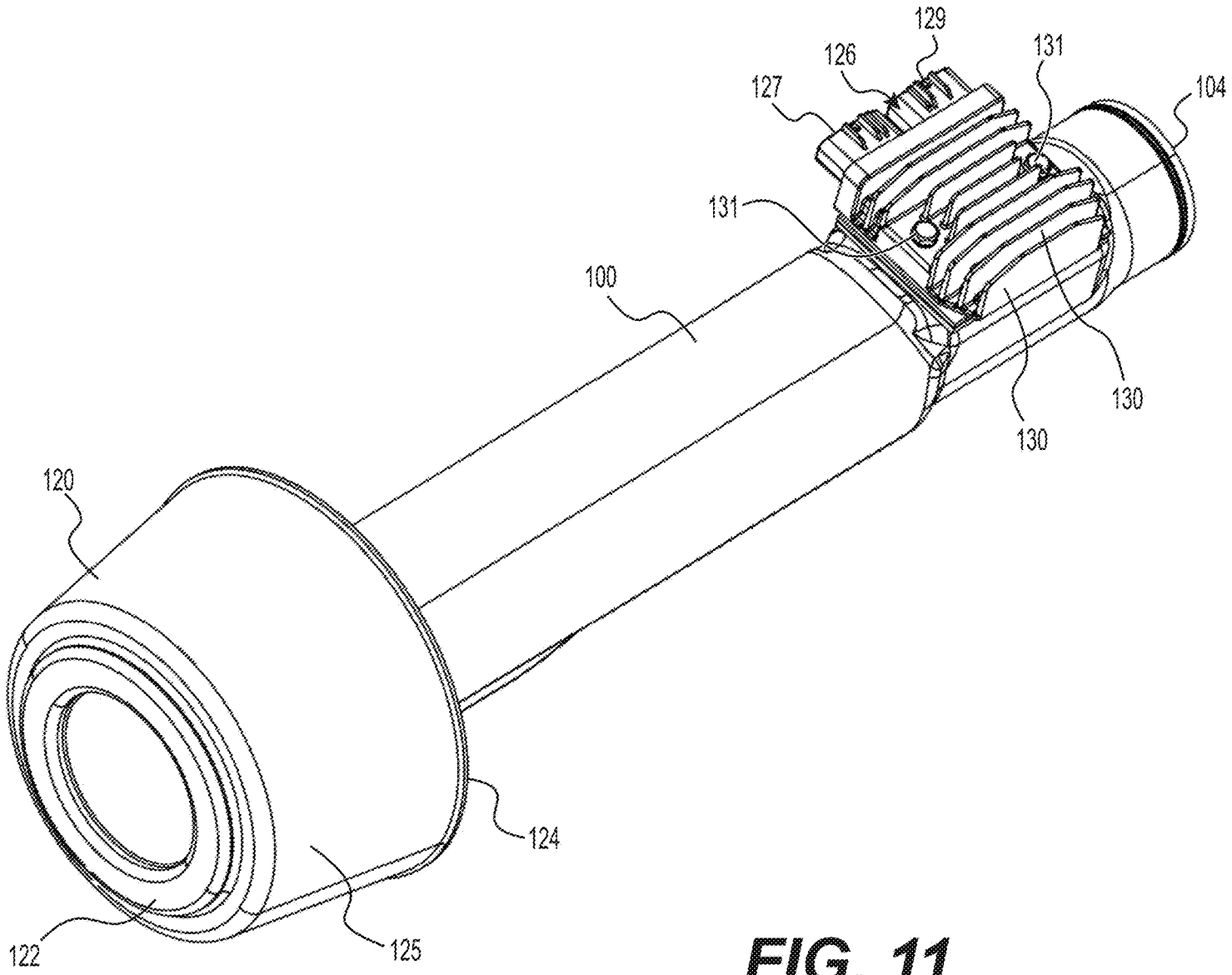
FIG. 11 is a perspective view taken from a front, left side of part of an air intake system of the engine assembly of FIG. 5, showing an air intake conduit and a shroud of the air intake system.

Returning now to the air intake conduit 100 with reference to FIGS. 4 and 5, the air intake conduit 100 is a straight pipe positioned to extend longitudinally such that the inlet end 102 thereof is disposed forwardly of the outlet end 104 and faces forwardly. Thus, as shown in FIG. 8, the air intake conduit 100 extends parallel to the crankshaft 70 of the engine 50, although other arrangements are contemplated. As can be seen in FIGS. 8 and 10, the air intake conduit 100 is also positioned vertically higher than the supercharger 110. Moreover, as can be seen in FIG. 3, the inlet end 102 of the air intake conduit 100 is located in a front portion 54 of the engine compartment 45. In the present embodiment, the inlet end 102 is disposed forward of the engine 50 and its cylinders 72. This forward position of the inlet end 102 can help minimize moisture content in the air flowing into the air intake conduit 100 since the front portion 54 is the portion of the engine compartment 45 where air is driest as it is furthest from bilge water when the jet boat 10 is in operation (due to the angled disposition of the jet boat 10 when travelling forward whereby the bow 13 is vertically higher than the stern 15). In addition, the front portion 54 is the portion of the engine compartment 45 where air is coolest as it is furthest away from the exhaust system components (muffler 56, resonator 62). Conversely, as can be seen in FIG. 8, the outlet end 104 of the air intake conduit 100 is disposed rearward of the engine 50 such that the inlet and outlet ends 102, 104 are disposed on opposite longitudinal sides of the engine 50.

The length of the air intake conduit 100, measured from the inlet end 102 to the outlet end 104, can be chosen for a specific sound attenuation performance More particularly, a combined conduit length of the air intake conduit 100 and the conduit 108 that fluidly connects the air intake conduit 100 to the supercharger 110 is designed to attenuate a particular set of frequencies.

It is contemplated that the air intake conduit 100 may be shaped differently in other embodiments. For instance, the air intake conduit 100 may be curved or otherwise follow a path different from the rectilinear path illustrated herein.

Figure 13:
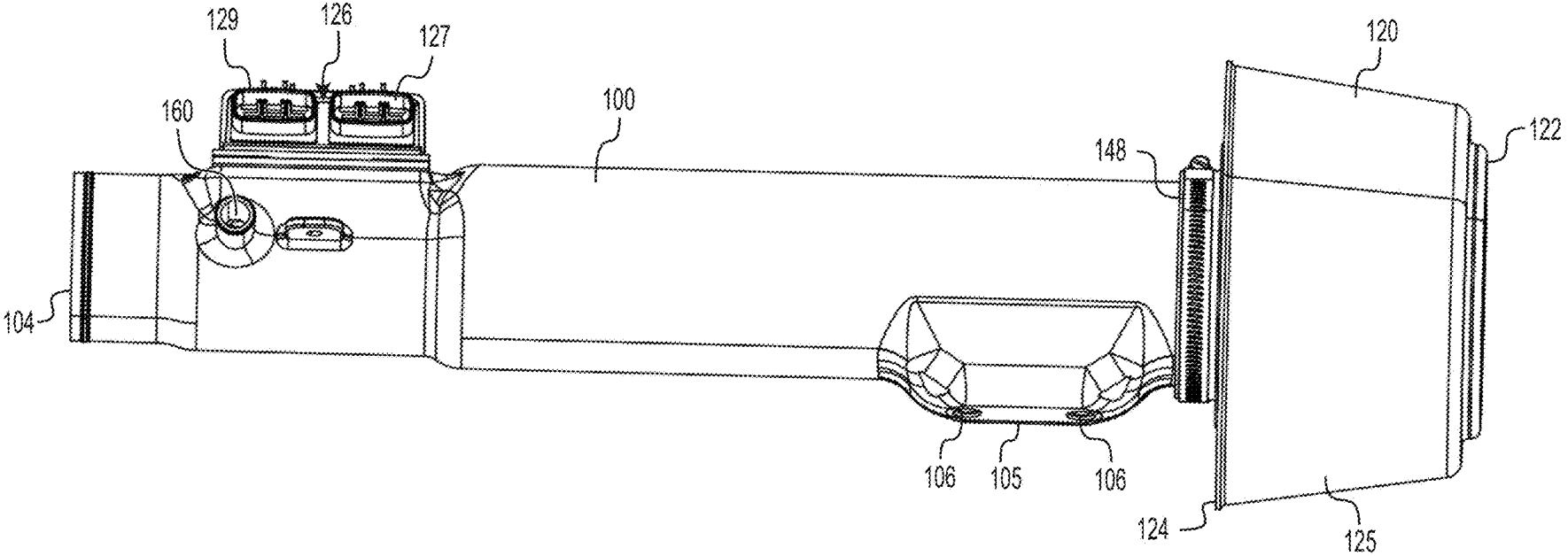
FIG. 13 is a right side elevation view of the part of the air intake system of FIG. 11.
Figure 14:
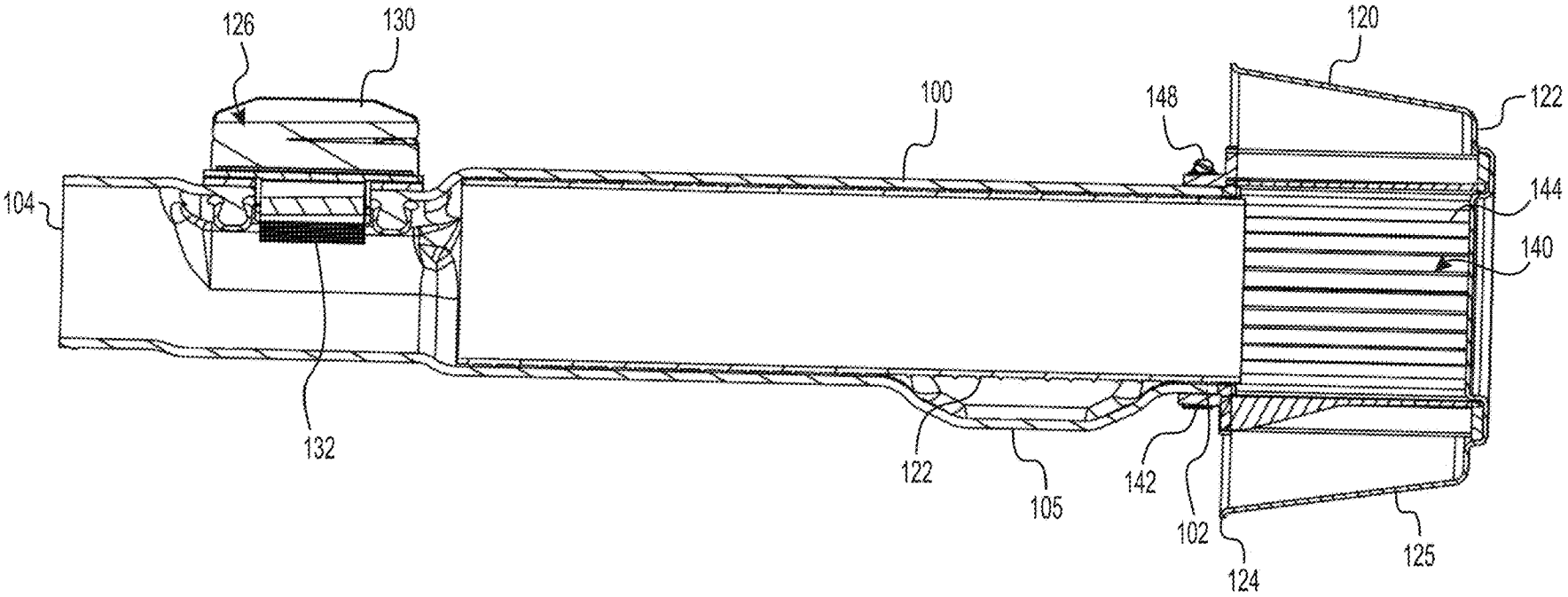
FIG. 14 is a cross-sectional view of the part of the air intake system of FIG. 11 taken along line 14-14 in FIG. 12.

As shown in FIGS. 13 and 14, the air intake conduit 100 has a connecting mount 105 protruding downwardly near the inlet end 102. The connecting mount 105 defines openings 106 (FIG. 13) which receive fasteners to connect the air intake conduit 100 to an engine bracket 95 (FIG. 8).

Figure 15:
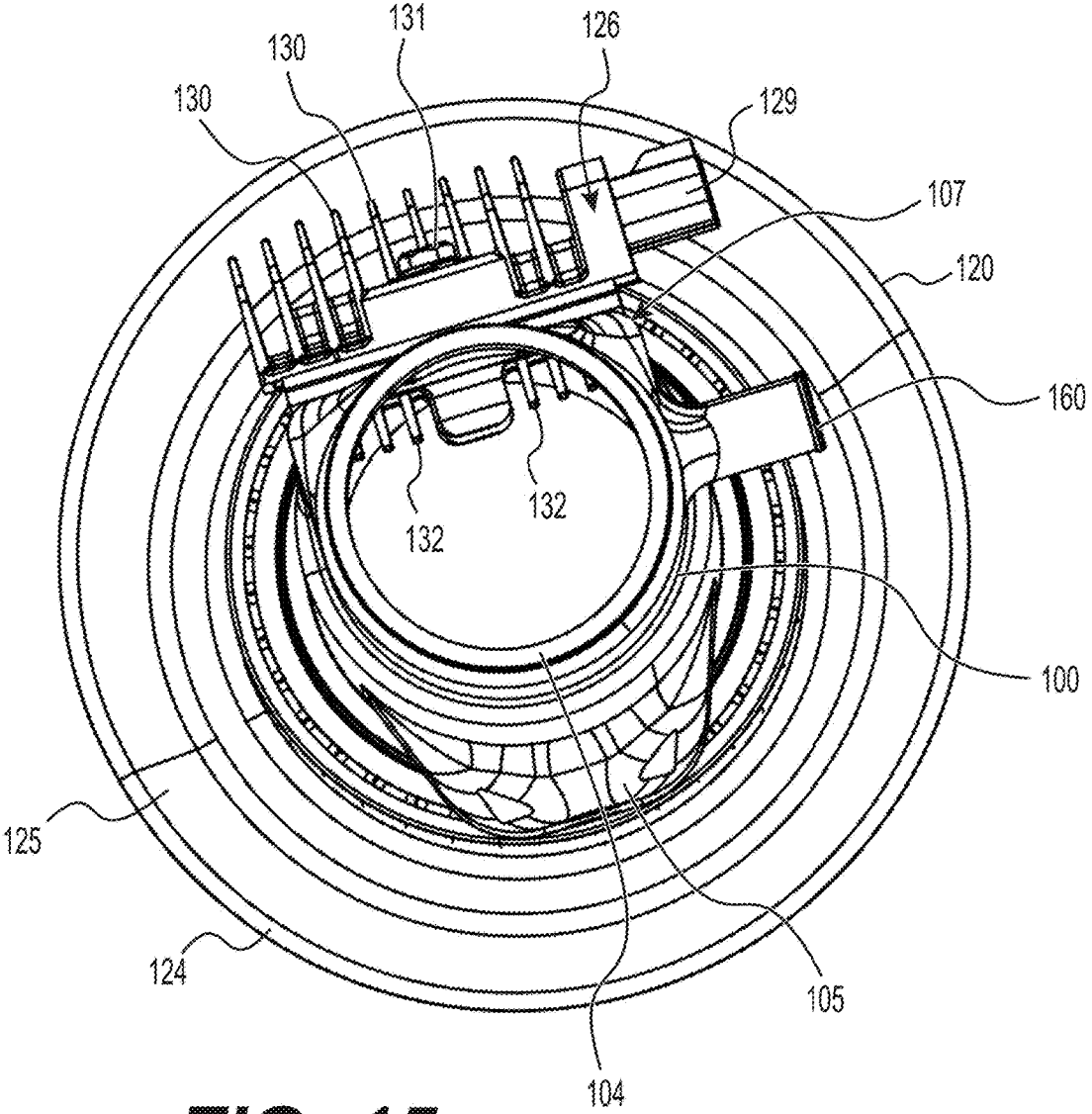
FIG. 15 is a rear elevation view of the part of the air intake system of FIG. 11.

The air intake conduit 100 also has a voltage regulator mount 107 (FIGS. 15 and 16) near the outlet end 104. The voltage regulator mount 107 is disposed at a section of the air intake conduit 100 which has a smaller cross-sectional area than the inlet end 102. The voltage regulator mount 107 defines an opening 109 for providing access into the air intake conduit 100. A voltage regulator 126 is connected to the voltage regulator mount 107 via fasteners 131 securely received in corresponding fastener-receiving openings defined by the voltage regulator mount 107. The voltage regulator 126 is configured to convert an alternating current (AC) voltage input received at an input connector 127 to a direct current (DC) voltage output transmitted through an output connector 129. Onboard electronic systems of the jet boat 10 can be electrically connected to the output connector 129 such as to use the DC output thereof. The voltage regulator 126 has heat sink fins to promote cooling of the voltage regulator 126. In particular, as shown in FIG. 15, the voltage regulator 126 has outer heat sink fins 130 which extend outside of the air intake conduit 100 and inner heat sink fins 132 which extend inside the air intake conduit 100. Notably, the inner heat sink fins 132 form part of the voltage regulator 126 which is inserted into the opening 109 defined by the voltage regulator mount 107. As such, the voltage regulator 126 is cooled by air flowing through the air intake conduit 100 over the inner heat sink fins 132.

Figure 12:
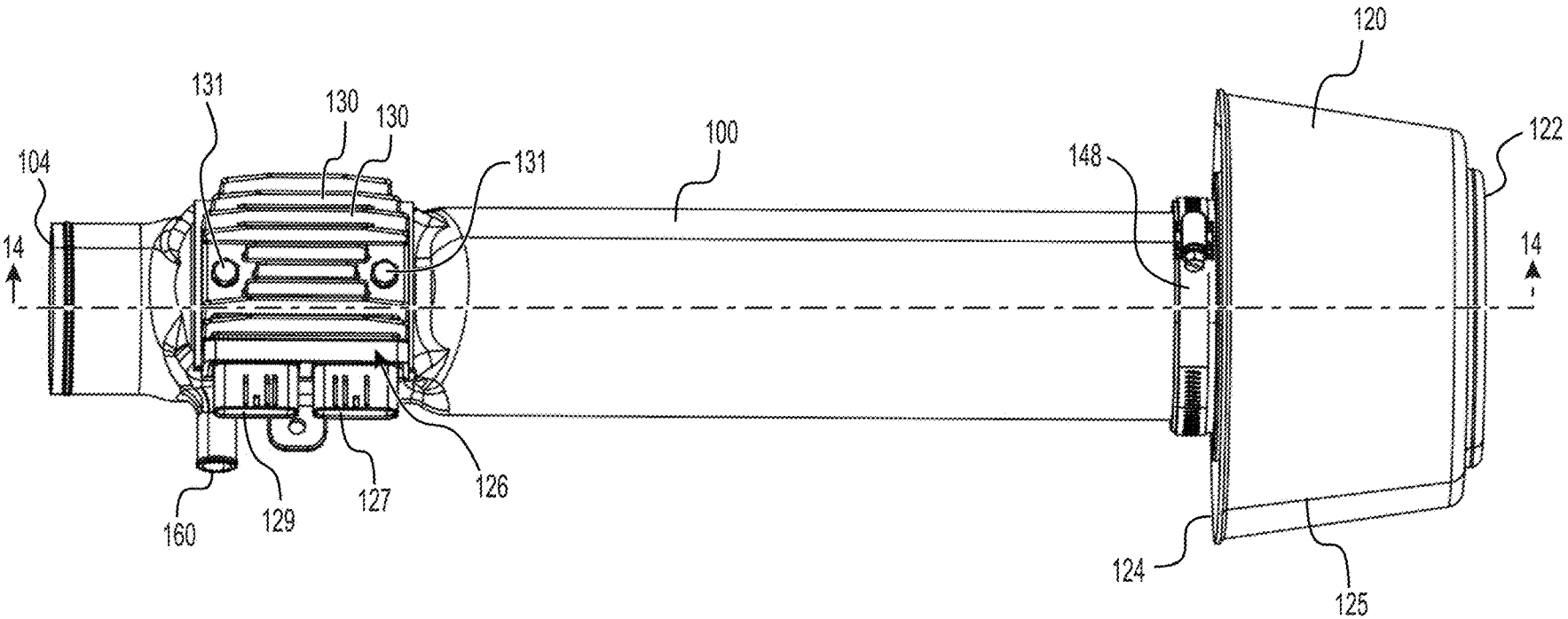
FIG. 12 is a top plan view of the part of the air intake system of FIG. 11.

Furthermore, with particular reference to FIGS. 12 and 13, the air intake conduit 100 also has a secondary inlet 160 for an engine breather hose, also called a crankcase ventilation hose, that routes blow-by gas into the air intake conduit 100. The secondary inlet 160 is disposed near the outlet end 104.

Figure 16:
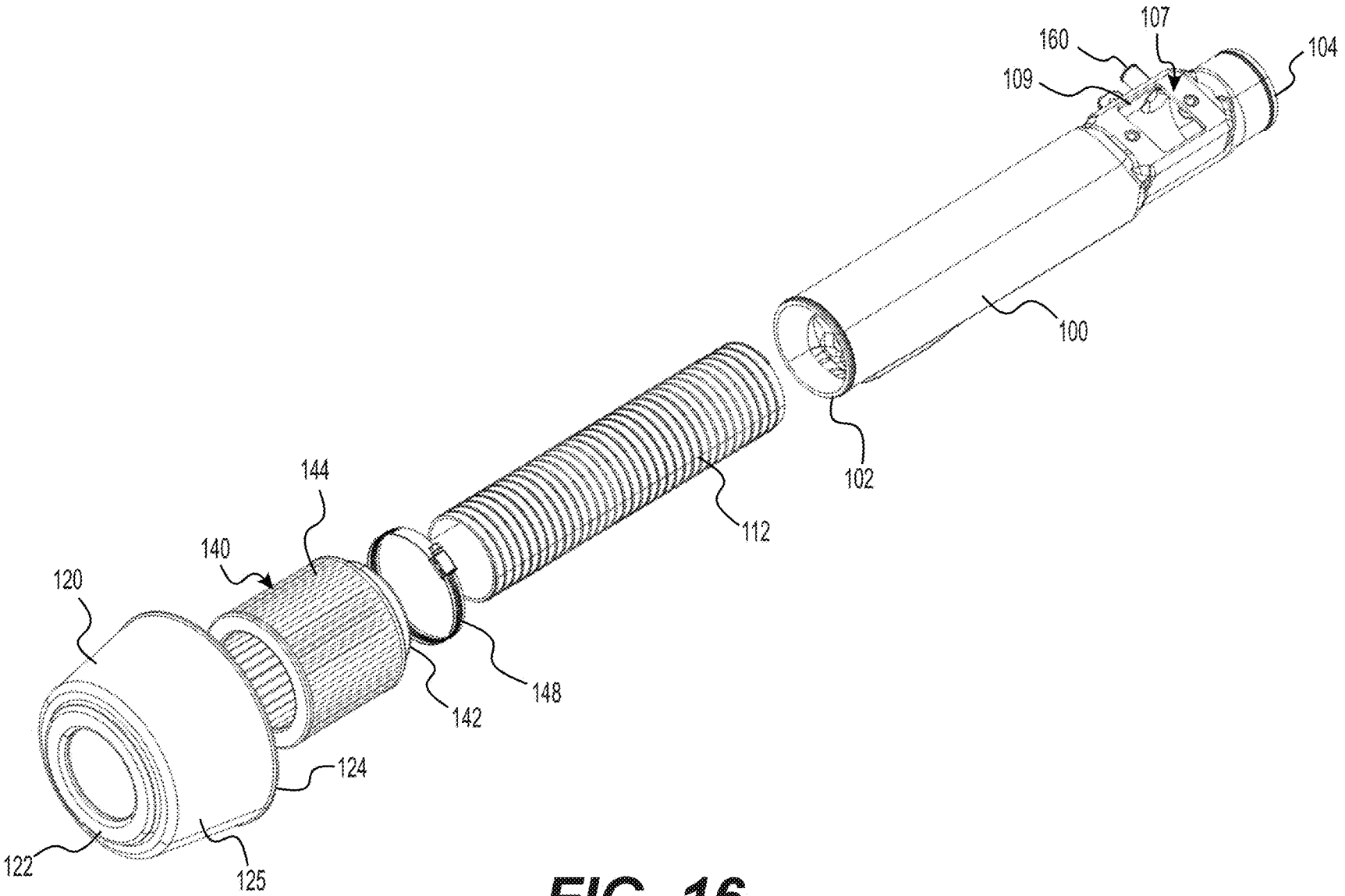
FIG. 16 is an exploded view, taken from a front, left side, of the part of the air intake system of FIG. 11.
Figure 17:
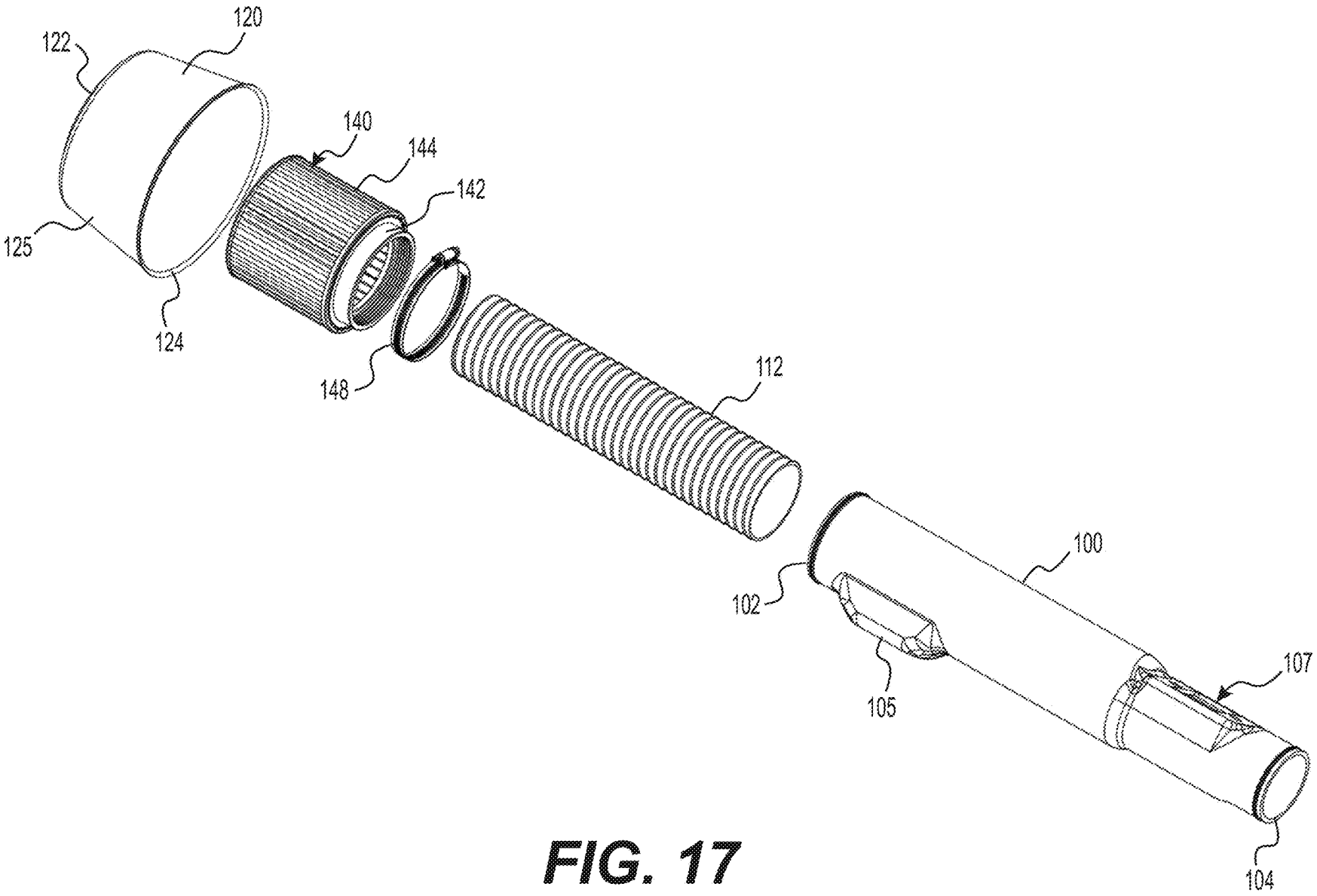
FIG. 17 is an exploded view, taken from a rear, left side, of the part of the air intake system of FIG. 11.
Figure 18:
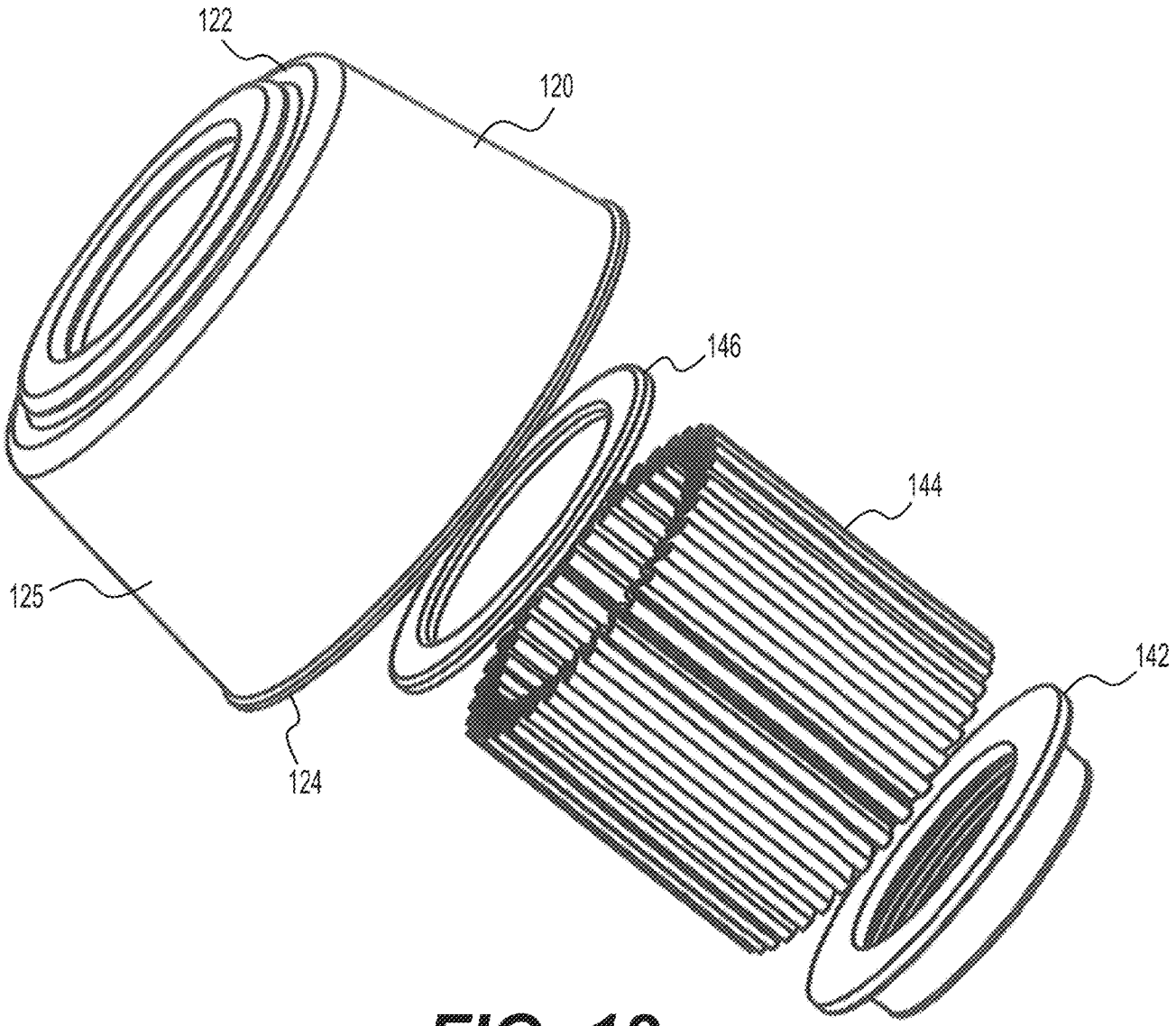
FIG. 18 is an exploded view, taken from a left side, of an air filter and the shroud of the part of the air intake system of FIG. 11.

As shown in FIGS. 14, 16 and 17, a tubular liner 112 is disposed inside the air intake conduit 100 to help attenuate sound travelling through the air intake conduit 100. The liner 112 includes a sound-attenuating material and an expanded wire for providing rigidity to the sound-attenuating material. In this embodiment, the sound-attenuating material is felt. The sound-attenuating material could be any other suitable material in other embodiments. The liner 112 is prevented from going to the outlet end 104 by the reduced cross-sectional area section of the air intake conduit 100 in which the voltage regulator mount 107 is located. Notably, the diameter of the liner 112 is greater than the diameter of the reduced cross-sectional area section of the air intake conduit 100.

As shown in FIG. 14, an air filter 140 is fluidly connected to the inlet end 102 of the air intake conduit 100 for filtering air flowing into the air intake conduit 100. Notably, in this embodiment, the air filter 140 covers the inlet end 102 of the air intake conduit 100 to filter air at the inlet end 102. The air filter 140 is generally tubular and has a collar 142 and a filtering member 144 affixed (e.g., bonded) to the collar 142. In this embodiment, a black polyurethane potted compound is used to affix the filtering member 144 to the collar 142. A clamp 148 is used to secure the collar 142 of the air filter 140 to the inlet end 102 of the air intake conduit 100. Alternatively, the collar 142 could have an internal thread for engaging an external thread at the inlet end 102 of the air intake conduit 100.

In this embodiment, the filtering member 144 is a pleated paper filtering member arranged to form a cylinder. It is contemplated that the filtering member 144 could be made of any other suitable material (e.g., foam, cotton, etc.). Furthermore, it is contemplated that the filtering member 144 could be dome-shaped, flat, or have any other suitable shape in other embodiments.

As shown in FIGS. 11 to 17, a shroud 120 is provided at the inlet end 102 of the air intake conduit 100 to deflect sound and vibrations exiting the engine 50 through the air intake conduit 100. The shroud 120 has a first end 122 and a second end 124 opposite the first end 122. The first end 122 is "closed" in that it is closed to flow of air therethrough and may thus be referred to as the closed end 122 of the shroud 120. On the other hand, the second end 124 is "open" in that it is open to flow of air therethrough and may thus be referred to as the open end 124 of the shroud 120. The shroud 120 is connected to the inlet end 102 of the air intake conduit 100 via the air filter 140 such that a sidewall 125 of the shroud 120, extending between the closed and open ends 122, 124, surrounds the inlet end 102. The shroud 120 further includes a front wall 147 (FIG. 19) that extends across the forward end of the filtering member 144, radially inward from an annular sealing member 146, thereby closing the closed end 122. The shroud 120 is oriented such that the open end 124 is disposed rearward of the closed end 122 (i.e., with the opened end 124 facing rearward). Moreover, as can be seen in FIGS. 7 to 9, the shroud 120 is disposed forward of the engine 50, its cylinders 72, the intake manifold 60 and the exhaust manifold 61.

Figure 19:
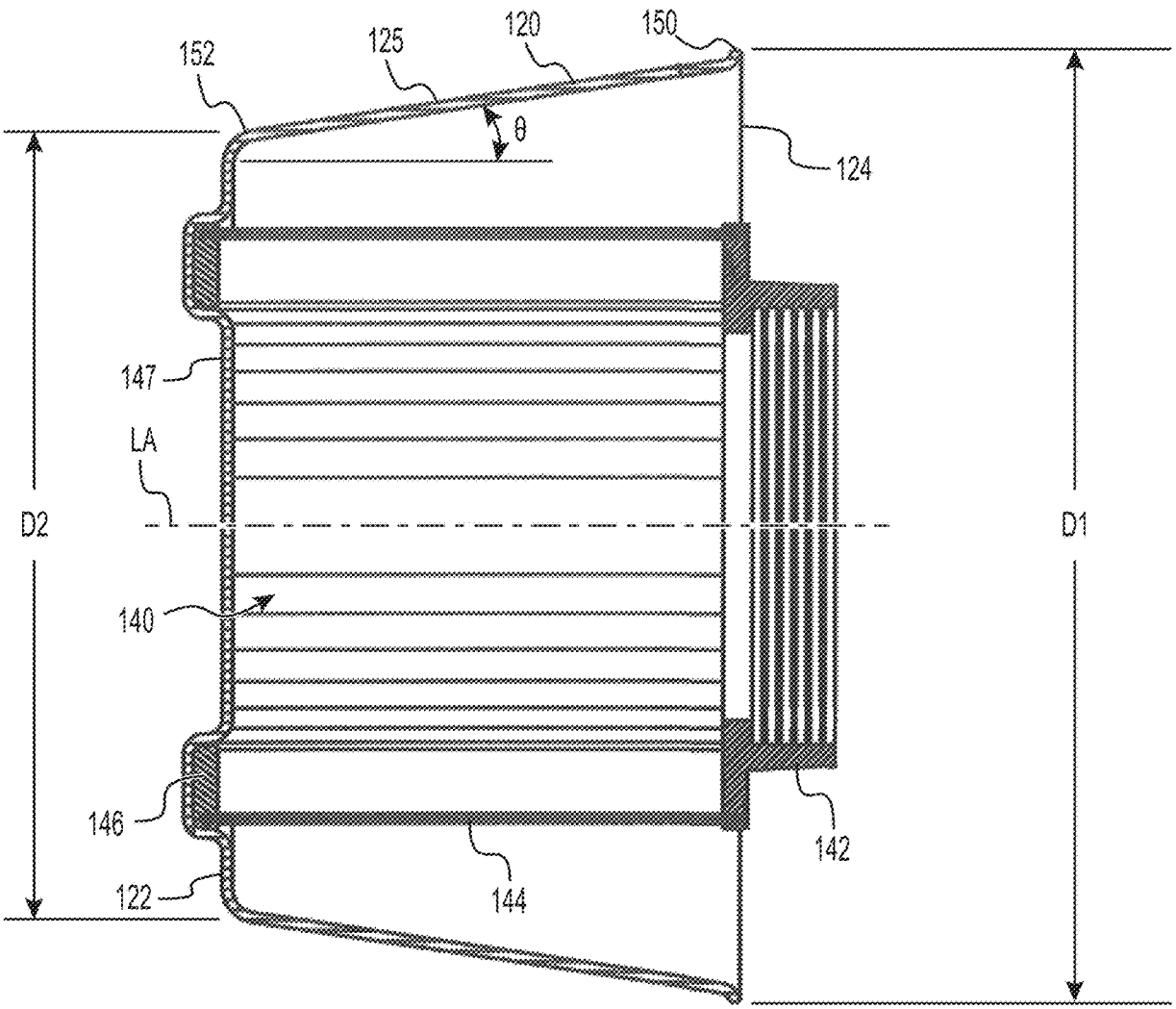
FIG. 19 is a cross-sectional view of the shroud and the air filter of FIG. 18.

In this embodiment, with reference to FIG. 19, the shroud 120 is shaped such that a peripheral edge 150 (which may be referred to as a "rear" peripheral edge 150) of the open end 124 has a perimeter that is greater than a perimeter of a peripheral edge 152 (which may be referred to as a "front" peripheral edge 152) of the closed end 122. More specifically, in this embodiment, the shroud 120 is generally frustoconical such that the peripheral edges 150, 152 are circular and a diameter D1 of the open end 124 (i.e., the diameter of the peripheral edge 150) is greater than a diameter D2 of the closed end 122 (i.e., the diameter of the peripheral edge 152). As such, the sidewall 125 of the shroud 120 extends at an angle θ relative to a longitudinal axis LA of the shroud 120 (which extends parallel to the longitudinal direction of the jet boat 10). In this embodiment, the angle θ is approximately 10°. It is contemplated that the angle θ could be between 5° and 15° in other embodiments. Other angles are also contemplated.

The shroud 120 is generally sized and shaped to avoid choking the engine 50 (i.e., limiting the air provided thereto and thus altering the air-to-fuel ratio fed to the cylinders 72) while simultaneously being compact enough to fit in the limited space available within the engine compartment 45 and reflect noise and vibration rearward.

As shown in FIG. 19, in this embodiment, the shroud 120 is connected to the air filter 140. More specifically, an inner surface of the closed end 122 facing rearward is affixed to a front end of the filtering member 144. In this embodiment, a black polyurethane potted compound is used to bond the closed end 122 of the shroud 120 to the filtering member 144. Any other suitable adhesive or attachment means may be used in other embodiments. The adhesive notably forms the annular sealing member 146 disposed at the front end of the filtering member 144, between the filtering member 144 and the inner surface of the closed end 122 which prevents leaks therebetween. As can be seen, the air filter 140 is thus disposed inside the shroud 120 as the sidewall 125 surrounds the air filter 140. As such, the shroud 120 protects the air filter 140 from potential exposure to water and any loose matter in the engine compartment 45.

Together, the air intake conduit 100, the shroud 120 and the air filter 140 define a front portion of the air intake system of the engine assembly. Notably, the shroud 120 is a front-most element of the air intake system. Moreover, the air intake conduit 100, the shroud 120 and the air filter 140 are coaxial with one another.

In other words, the respective centers of each of the air intake conduit 100, the shroud 120 and the air filter 140 are aligned with one another.

The positioning of the shroud 120 as described above can help reduce noise and vibrations to which the driver and/or passengers of the jet boat 10 are subjected. Notably, noise emitted by the engine 50 which travels through the air intake system and exit the inlet end 102 and the air filter 140 are reflected generally rearward (i.e. at least in part away from the front portion 54 of the engine compartment 45) by the shroud 120. In the present embodiment, the axis LA of the shroud 120 extends longitudinally and the shroud 120 opens directly rearward, although it is contemplated that the axis LA of the shroud 120 could extend longitudinally and/or laterally and/or vertically, thereby reflecting noise and vibrations in part rearward and/or in part sideways and/or in part upward or downward. Since the passenger seats 34 are proximate the front portion 54 of the engine compartment 45, as shown in FIG. 1, this may particularly reduce the noise to which the passengers seated at the passenger seats 34 are subjected, thereby increasing the comfort of the occupants of the jet boat 10. By the same token, the inlet end 102 of the air intake conduit 100 can be positioned as far forward as shown herein because the shroud 120 redirects the noise and vibrations emitted by the engine 50 rearward, as it may otherwise prove to be excessive for passengers if the shroud 120 were not present.

Figure 20:
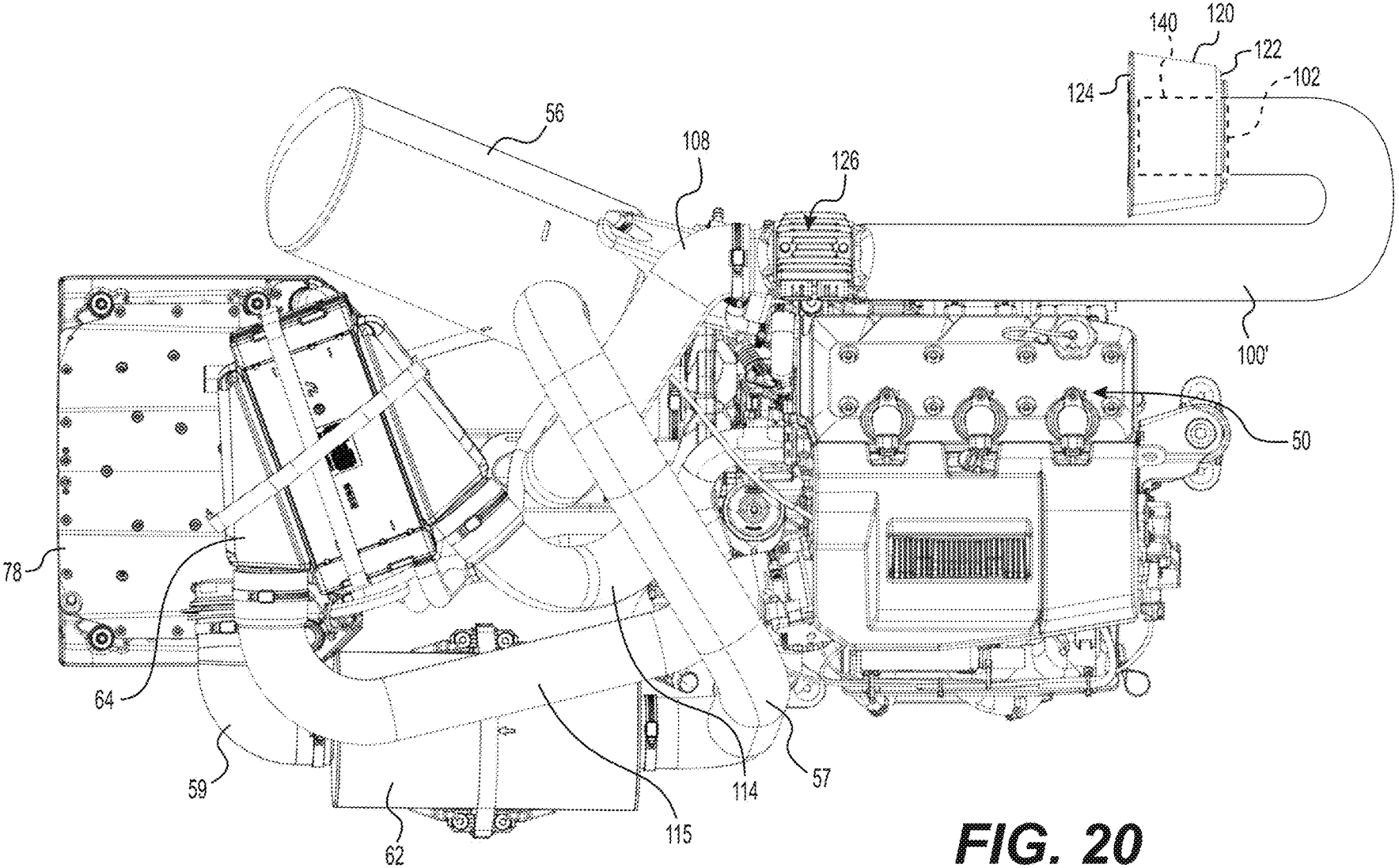
FIG. 20 is a top plan view of the engine assembly in accordance with an alternative embodiment.

As briefly mentioned above, the air intake conduit 100 may be configured differently while still maintaining the advantages provided by the shroud 120. Notably, in an alternative embodiment, as shown in FIG. 20, an air intake conduit 100' is provided which, in contrast with the air intake conduit 100 described above, has its inlet end 102 facing generally rearward instead of forward. In this alternative embodiment, the closed end 122 of the shroud 120 defines an opening (not shown) which is connected to the inlet end 102 of the air intake conduit 100, and more specifically at the joint between the filter 140 and the inlet end 102. Despite defining an opening, the closed end 122 is still "closed" since flow of air is closed therethrough while the flow of air is open through the open end 124. Furthermore, as can be seen, in this alternative embodiment, the air intake conduit 100' has a straight portion 101 and a curved portion 103. As will be understood, the shroud 120 connected to the air intake conduit 100' reflects noise and vibrations from the engine 50 rearward in a similar manner to that described above.

While the present technology has been described in relation to the jet boat 10, it is contemplated that the present technology may be used in other types of watercraft such as a personal watercraft (PWC) for example.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A watercraft comprising:

a hull having a bow and a stern opposite the bow;

an engine compartment defined at least in part by the hull;

an internal combustion engine disposed in the engine compartment;

an air intake conduit fluidly connected to the engine, the air intake conduit having an inlet end and an outlet end, the inlet end being located in the engine compartment;

an air filter fluidly connected to the air intake conduit for filtering air flowing into the air intake conduit; and a shroud connected to the inlet end of the air intake conduit, the shroud having an open end and a closed end, the open end being open to flow of air therethrough, the closed end being closed to flow of air therethrough, the shroud having a sidewall extending between the closed and open ends, the shroud being oriented such that the open end is disposed rearward of the closed end, wherein noise exiting the inlet end of the air intake conduit and the air filter is reflected generally rearward by the shroud.

2. The watercraft of claim 1, wherein:

the open end has a rear peripheral edge;

the closed end has a front peripheral edge; and a perimeter of the rear peripheral edge is greater than a perimeter of the front peripheral edge.

3. The watercraft of claim 2, wherein:

the rear and front peripheral edges are circular; and a diameter of the rear peripheral edge is greater than a diameter of the front peripheral edge.

4. The watercraft of claim 1, wherein:

the shroud is generally frustoconical; and the open end has a diameter that is greater than a diameter of the closed end.

5. The watercraft of claim 1, wherein the inlet end of the air intake conduit is located in a front portion of the engine compartment.

6. The watercraft of claim 5, wherein the engine comprises:

a crankcase;

a crankshaft disposed at least in part in the crankcase;

a cylinder block connected to the crankcase;

at least one cylinder defined in the cylinder block; and at least one piston movably disposed within a corresponding one of the at least one cylinder, each of the at least one piston being operatively connected to the crankshaft, the shroud being disposed forward of each of the at least one cylinder.

7. The watercraft of claim 1, wherein the engine comprises:

a crankcase;

a crankshaft disposed at least in part in the crankcase, the crankshaft extending longitudinally;

a cylinder block connected to the crankcase;

at least one cylinder defined in the cylinder block; and at least one piston movably disposed within a corresponding one of the at least one cylinder, each of the at least one piston being operatively connected to the crankshaft, wherein the air intake conduit extends parallel to the crankshaft.

8. The watercraft of claim 1, further comprising:

a supercharger fluidly connected between the outlet end of the air intake conduit and the engine to compress and feed air to the engine.

9. The watercraft of claim 8, wherein the supercharger is disposed rearward of the engine.

10. The watercraft of claim 1, wherein the air filter covers the inlet end of the air intake conduit.

11. The watercraft of claim 1, wherein the shroud is connected to the air filter.

12. The watercraft of claim 1, wherein the inlet end of the air intake conduit faces forwardly.

13. The watercraft of claim 1, wherein the air intake conduit extends longitudinally.

14. The watercraft of claim 1, wherein the inlet end and the outlet end of the air intake conduit are disposed on opposite longitudinal sides of the engine.

15. The watercraft of claim 1, wherein the inlet end faces rearward.

16. The watercraft of claim 1, wherein the air filter is generally tubular.

17. The watercraft of claim 1, wherein the engine compartment is located at a rear portion of the watercraft.

18. The watercraft of claim 1, further comprising:

a driver seat; and at least one passenger seat disposed behind the driver seat, the at least one passenger seat being proximate a front portion of the engine compartment.

19. The watercraft of claim 1, further comprising a jet propulsion system driven by the engine.

20. The watercraft of claim 1, wherein the air filter is disposed inside the shroud.

21. The watercraft of claim 1, wherein the air filter comprises a pleated paper filtering member.

22. The watercraft of claim 1, wherein the air intake conduit has a secondary inlet near the outlet end for ingress of blow-by gas into the air intake conduit.

23. The watercraft of claim 1, further comprising an air intake manifold, the air intake manifold and the air intake conduit being disposed on opposite lateral sides of the engine.

24. The watercraft of claim 23, further comprising:

a supercharger fluidly connected between the outlet end of the air intake conduit and the engine to compress and feed air to the engine, the supercharger being disposed laterally between the air intake manifold and the air intake conduit.

25. The watercraft of claim 1, wherein:

the air intake conduit, the air filter and the shroud define in part an air intake system of the watercraft; and the shroud is a front-most element of the air intake system.

26. The watercraft of claim 1, further comprising a deck disposed on top of and connected to the hull, the deck also defining the engine compartment.

27. The watercraft of claim 1, wherein the air intake conduit is a straight pipe.

28. The watercraft of claim 1, further comprising:

a supercharger fluidly connected between the outlet end of the air intake conduit and the engine to compress and feed air to the engine, the air intake conduit being vertically higher than the supercharger.

29. The watercraft of claim 1, wherein the air intake conduit, the shroud, and the air filter are coaxial with one another.

30. The watercraft of claim 1, wherein the sidewall of the shroud extends at an angle between 5° and 15° relative to a longitudinal axis of the shroud.

31. An engine assembly for a watercraft, comprising:

an internal combustion engine comprising:

a crankcase;

a crankshaft disposed at least in part in the crankcase;

a cylinder block connected to the crankcase;

at least one cylinder defined in the cylinder block; and at least one piston movably disposed within a corresponding one of the at least one cylinder, each of the at least one piston being operatively connected to the crankshaft;

an air intake conduit fluidly connected to the engine, the air intake conduit having an inlet end and an outlet end, the inlet end being disposed on a first side of the engine, the outlet end of the air intake conduit being disposed on a second side of the engine, the first side being opposite the second side;

an air filter fluidly connected to the air intake conduit for filtering air flowing into the air intake conduit; and a shroud connected to the inlet end of the air intake conduit, the shroud having an open end and a closed end, the open end being open to flow of air therethrough, the closed end being closed to flow of air therethrough, the shroud having a sidewall extending between the closed and open ends, the shroud being oriented such that a distance between the open end and the second side of the engine is less than a distance between the closed end and the second side of the engine.

32. The engine assembly of claim 31, wherein the air intake conduit extends parallel to the crankshaft.

33. The engine assembly of claim 31, wherein each of the at least one cylinder of the engine is disposed between the shroud and the second side of the engine.

34. The engine assembly of claim 31, further comprising a supercharger fluidly connected between the outlet end of the air intake conduit and the engine to compress and feed air to the engine.

35. The engine assembly of claim 34, wherein the supercharger is disposed on the second side of the engine.

36. The watercraft of claim 34, further comprising an air intake manifold, the air intake manifold and the air intake conduit being disposed on opposite lateral sides of the engine.

37. The watercraft of claim 36, wherein the supercharger is disposed laterally between the air intake manifold and the air intake conduit.

* * * * *